US005575970A

United States Patent [19]

Coble

[11] Patent Number: 5,575,970

[45] Date of Patent: Nov. 19, 1996

[54] CAST REFRACTORY BASE SEGMENTS AND MODULAR FIBER SEAL SYSTEM FOR PLURAL-STACK ANNEALING FURNACE

[76] Inventor: Gary L. Coble, RD#2, Box 214, DuBois, Pa. 15801

[21] Appl. No.: 647,676

[22] Filed: May 15, 1996

Related U.S. Application Data

[60] Division of Ser. No. 423,010, Apr. 14, 1995, which is a continuation-in-part of Ser. No. 32,593, Dec. 21, 1995, Ser. No. 32,592, Dec. 21, 1995, Pat. No. Des. 371,837, Ser. No. 32,591, Dec. 21, 1995, Pat. No. Des. 374,073, Ser. No. 32,587, Dec. 21, 1995, Ser. No. 32,589, Dec. 21, 1995, Pat. No. Des. 371,836, Ser. No. 32,590, Dec. 21, 1995, and Ser. No. 32,588, Dec. 21, 1995, Pat. No. Des. 374,072.

[51] Int. Cl.[6] ..... F27D 1/00

[52] U.S. Cl. ..... 266/44; 266/263; 266/283

[58] Field of Search ..... 266/263, 280, 266/283, 281, 286, 44; 264/30

[56] References Cited

U.S. PATENT DOCUMENTS

| | | | |
|---|---|---|---|
| 257,630 | 5/1882 | Whitney | 446/85 |
| D. 344,350 | 2/1994 | De Pascale et al. | D25/113 |
| 1,829,320 | 10/1931 | White | 266/286 |
| 2,998,236 | 8/1961 | Cramer et al. | 263/40 |
| 3,039,754 | 6/1962 | Jones | 263/47 |
| 3,081,074 | 3/1963 | Blackman et al. | 263/47 |
| 3,149,827 | 9/1964 | Whitten | 263/47 |
| 3,693,955 | 9/1972 | Wald et al. | 266/5 |
| 4,011,683 | 3/1977 | De Sousa | 46/25 |
| 4,287,940 | 3/1981 | Corbett, Jr. | 165/48 |
| 4,294,438 | 10/1981 | Nystrom et al. | 266/280 |
| 4,310,302 | 1/1982 | Thekdi | 432/205 |
| 4,366,255 | 12/1982 | Lankard | 501/95 |
| 4,516,758 | 5/1985 | Coble | 266/263 |
| 4,611,791 | 9/1986 | Coble | 266/263 |
| 4,647,022 | 3/1987 | Coble | 266/282 |
| 4,653,171 | 3/1987 | Coble | 29/455 |
| 4,755,236 | 7/1988 | Coble | 148/13 |
| 5,048,802 | 9/1991 | Coble | 266/263 |
| 5,308,046 | 5/1994 | Coble | 266/263 |
| 5,335,897 | 8/1994 | Coble | 266/286 |
| 5,483,548 | 1/1996 | Coble | 373/75 |

FOREIGN PATENT DOCUMENTS

| | | | |
|---|---|---|---|
| 1131246 | 12/1956 | Germany | 266/262 |

OTHER PUBLICATIONS

Lee Wilson Engineering Co., Brochure Entitled "Lee Wilson—Foremost Engineers & Manufacturers of Annealing Furnaces & Auxiliary Equipment," 8 pages, Jun. 1968.

*Primary Examiner*—Scott Kastler
*Attorney, Agent, or Firm*—David A. Burge

[57] ABSTRACT

A rigid ceramic refractory base for a plural-stack annealing furnace is assembled atop a base support structure utilizing a novel set of cast refractory segments, including spaced pairs of C-shaped inner segments that each are surrounded by a sub-set of outer segments. Defined between each set of inner segments and its surrounding sub-set of outer segments is a circular inner seal positioning trough that opens upwardly, and that has a tapered cross section that narrows with depth. A resilient but reinforced inner seal of novel form is installed in each of the troughs, with each of these seals utilizing upper and lower blankets of refractory fiber material that sandwich a plurality of elongate refractory fiber modules arranged end-to-end to circumferentially fill the trough. Each of the modules includes a serial array of compressed, cube-shaped blocks of fiber refractory material that are interspersed with thin, perforated metal members, with each of the arrays of fiber blocks and metal members being held together to form a module by metal rods that extend centrally therethrough and are welded to perforated metal members that cap opposite module ends. Selected surfaces of the outer segments may be reinforced by utilizing hard, wear and impact resistant, pre-cast refractory inserts that are anchored to the cast refractory outer segments during their fabrication. Associated methods of fabrication, assembly, use, maintenance, repair and replacement are disclosed.

57 Claims, 11 Drawing Sheets

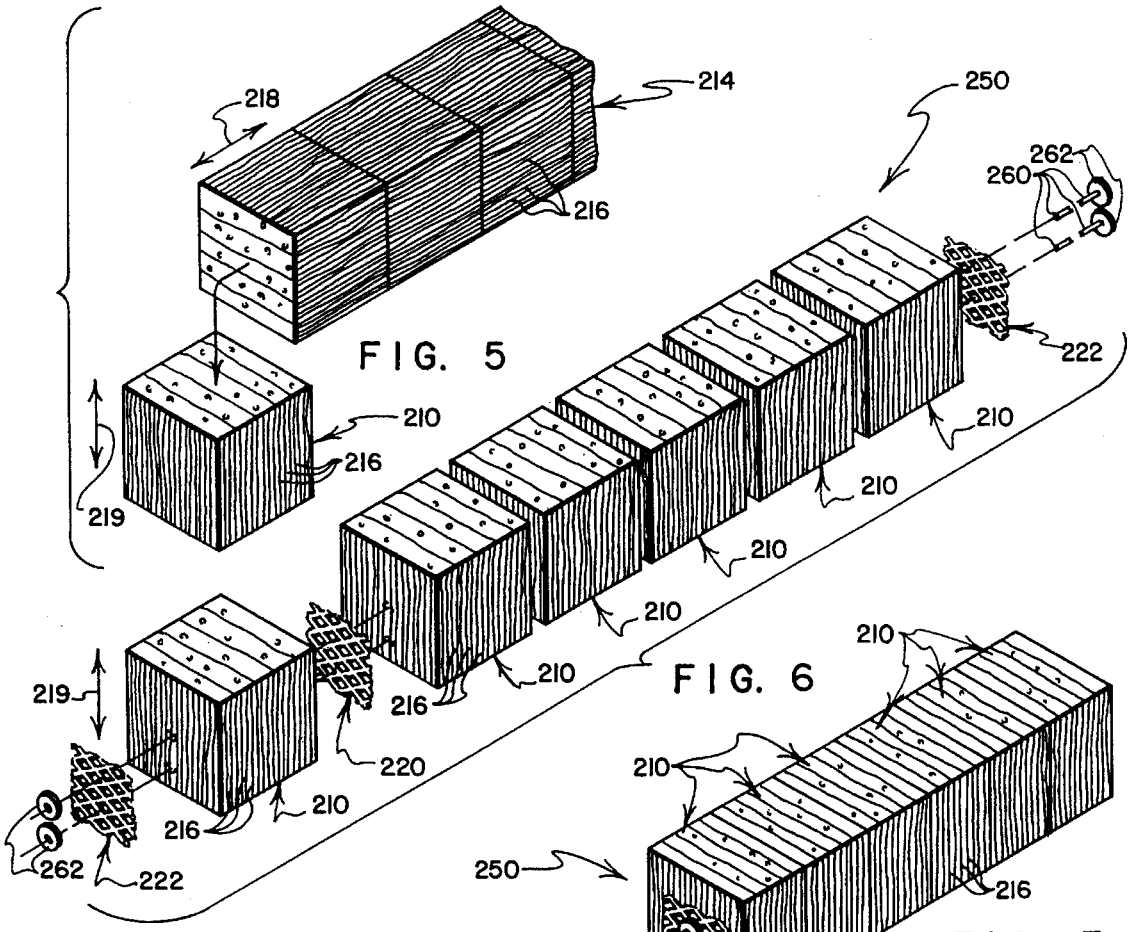
FIG. 5
FIG. 6
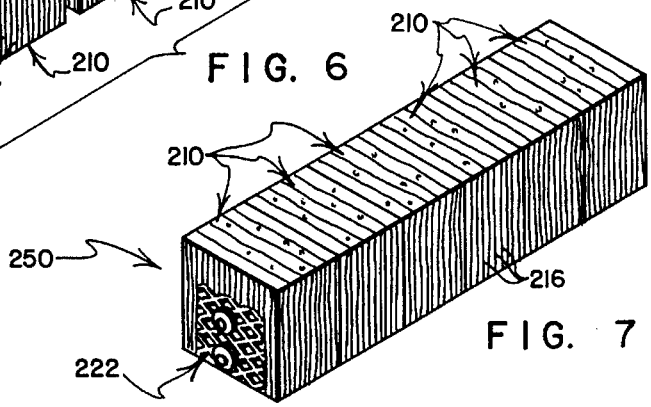
FIG. 7
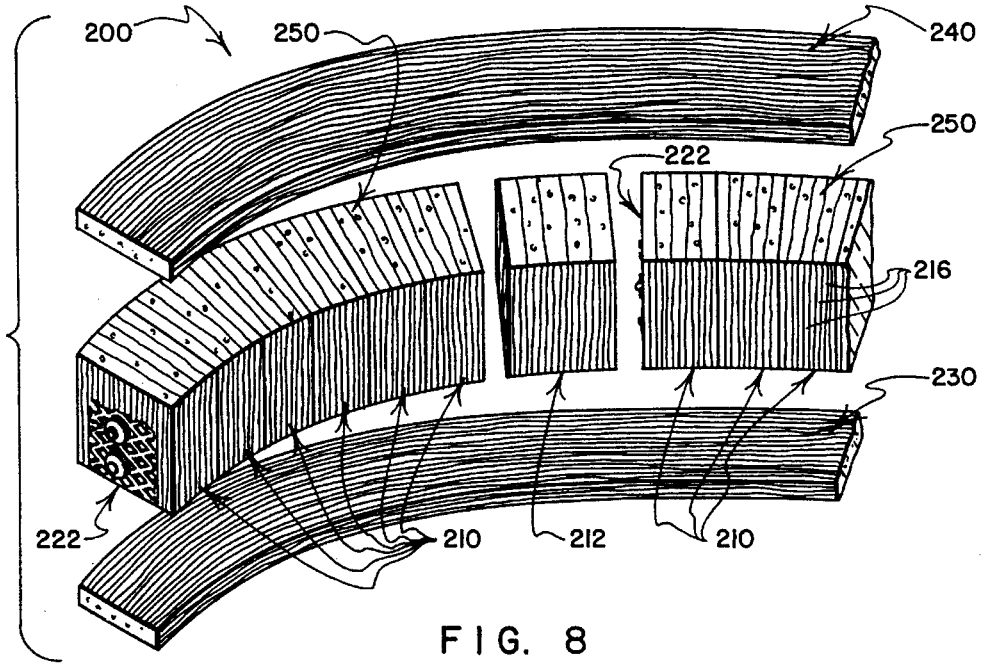
FIG. 8

CAST REFRACTORY BASE SEGMENTS AND MODULAR FIBER SEAL SYSTEM FOR PLURAL-STACK ANNEALING FURNACE

This is a division of application Ser. No. 08/423,010 filed Apr. 14, 1995 by Gary L. Coble, referred to hereinafter as the "Sister Case," the disclosure of which is incorporated herein by reference.

CROSS-REFERENCE TO RELATED APPLICATIONS

The Sister Case application is a continuation-in-part of each of the following co-pending applications of Gary L. Coble, referred to hereinafter as the "Cast Refractory Segment Cases," the disclosures of which are incorporated herein by reference:

CAST REFECTORY CENTER SEGMENT OF ANNEALING FURNACE BASE, Ser. No. 29/032,593 filed Dec. 21 1995;

CAST REFRACTORY CORNER SEGMENT OF ANNEALING FURNACE BASE, Ser. No 29/032,592 filed Dec. 21, 1995; now U.S. Pat. No. 371,837.

CAST REFECTORY CENTER SEGMENT OF ANNEALING FURNACE BASE, Ser. No. 29/032,591 filed Dec. 21, 1995; now U.S. Pat. No. 374,073.

ASSEMBLY OF CAST REFRACTORY SEGMENTS OF ANNEALING FURNACE BASE, Ser. No. 29/032,587 filed Dec. 21, 1995;

ASSEMBLY OF CAST REFRACTORY SEGMENTS OF ANNEALING FURNACE BASE, Ser. No. 29/032,389 filed Dec. 21, 1995; now U.S. Pat. No. 371,836.

ARCUATE CAST REFRACTORY AND STEEL SEGMENT OF ANNEALING FURNACE BASE, Ser. No. 29/032,590 filed Dec. 21, 1995;
and, ASSEMBLY OF ARCUATE CAST REFRACTORY AND STEEL SEGMENTS OF ANNEALING FURNACE BASE, Ser. No. 29/032,588 filed Dec. 21, 1995, now U.S. Pat. No. 374,072.

Reference also is made to a concurrent-filed subject-matter related application Ser. No. 08/423,009 filed Apr. 14, 1995 by Gary L. Coble entitled CAST REFRACTORY BASE SEGMENTS AND MODULAR FIBER SEAL SYSTEM FOR SINGLE-STACK ANNEALING FURNACE, referred to hereinafter as the "Companion Case," the disclosure of which is incorporated herein by reference.

BACKGROUND OF THE INVENTION

1. Field of the Invention

The present invention relates generally to the heat treating of metal such as coils of steel in a process known as annealing. More particularly, the present invention relates to the provision of and the use, in conjunction with the operation of a plural-stack annealing furnace, of a set of novel elongate modules of compressed, reinforced fiber refractory material to form an inner seal of the furnace, with the inner seal preferably including upper and lower blankets of refractory fiber material that sandwich therebetween a tightly packed end-to-end arrangement of the modules that, together with refractory fiber spacer blocks that preferably are utilized to separate adjacent pairs of the modules, circumferentially fill an upwardly opening seal positioning trough that has a cross section that narrows with depth, with the trough preferably being defined between inner and outer members of a novel set of cast refractory segments that form a rigid ceramic refractory base of the furnace. The cast refractory segments and the inner seal modules may be assembled on-site, or at a remote location for transport to and installation as a unit at a furnace site. The invention extends to features of the cast refractory and fiber seal base components, to features of furnace bases assembled from these novel components, to tools that preferably are used in installing, maintaining and repairing fiber seals in annealing furnace bases, and to methods of fabrication, assembly, use, maintenance, repair and replacement.

2. Prior Art

In a plural-stack annealing furnace, a fixed base structure typically having a plurality of equally spaced, centrally located charge support structures is used to support a plurality of charges of metal that are to be treated by subjecting the charges to an annealing process which typically includes a lengthy, controlled heating and controlled cool-down process in the controlled environments of a set of side-by-side treatment chambers wherein inert gas is circulated. The treatment chambers each are defined in large measure by a separate, open-bottom, tank-like inner enclosure of the furnace. Each inner enclosure is separately lowered into place about a separate one of the base-supported charges of metal, and each has a bottom rim that compressively engages a separate inner seal of the furnace which extends perimetrically about an associated one the charge support structures. Spaced outwardly from the inner seals is an outer seal that is engaged by an outer enclosure of the furnace that is lowered into seated engagement with the outer seal to heat a furnace chamber within which the inner enclosures are contained, which, in turn, transfer heat energy into the controlled environments of the treatment chambers.

Each inner seal typically is called upon not only to seal the associated treatment chamber 1) against the loss of its controlled gas atmosphere and 2) against contamination of the controlled atmosphere by leakage of ambient air into the treatment chamber, but also to physically support much, if not all, of the weight of the associated, lowered-in-place inner enclosure, the bottom rim of which is seated atop the inner seal once the inner enclosure has been lowered into place. In contrast, the while the outer seal typically is called upon 1) to prevent unwanted loss of heat energy from the furnace chamber and 2) to prevent entry into the furnace chamber of ambient air, the outer seal is seldom required to physically support much, if any, of the weight of the lowered-in-place outer enclosure of the furnace.

Sand has been widely used to form some of the inner and outer seals of annealing furnaces. While sand is desirable from the viewpoints 1) of being relatively inexpensive and 2) of being capable (if the sand happens to be distributed in a void-free and uniform manner beneath and along the entire perimeter of a depending rim of a furnace enclosure) to provide a reasonably effective seal, the use of sand in the highly active environment of a steel production facility is quite undesirable due to the fact that grains of sand are small and lightweight in character, and tend to spread themselves about the facility causing severe problems of product contamination.

Unacceptable sand contamination of steel product can result from a single grain of sand being moved out of either of an inner seal trough or an outer seal trough of an annealing furnace. For example, if a grain of sand is lifted above an annealing furnace base during the raising of one of the inner or outer enclosures of the furnace, and if the sand grain falls from the raised enclosure to become lodged in one of the many narrow spaces that may be present among adjacent wraps of a coil of steel, the errant sand grain probably will be pressed into the steel when the steel passes through the rolls of a temper mill, thereby causing an unacceptable product imperfection that, if found to be present very frequently in the output of a mill, may cause customers to purchase elsewhere.

In an effort to eliminate the use of sand seals in annealing furnaces, a wide variety of proposals have been made, some of which have made use of fiber refractory materials of Various forms that are laid in place in upwardly opening seal positioning grooves. While sand-substitute fiber seal proposals have, to some degree, been found to serve adequately to provide non-load-bearing outer seals of annealing furnaces, fiber seal proposals for use as load-bearing inner seals have inherently encountered a variety of drawbacks, chief among which has been their unduly high cost of use. Inner seals formed from refractory fiber have tended to be easily damaged during normal service use, have tended to be easily crushed under the weight of the inner enclosures that they must support, have tended to quickly lose their resilience or to otherwise quickly fail to provide gas impermeable barriers, and have, for these and other reasons, tended to require frequent replacement at unacceptably high cost.

Thus, while the desirability of utilizing refractory fiber materials to form outer and inner seals of annealing furnaces has been recognized, a problem that has been encountered in efforts to provide sand-substitute, fiber-type inner seals—a long-standing problem that has tended to defy the finding of a suitable solution—has been the combined need to provide a fiber-type inner seal structure that will remain sufficiently resilient over a suitably lengthy service life to ensure that a gas-impervious seal of good integrity is reliably maintained, while, at the same time, offering sufficient crush resistance and structural integrity to suitably support the weight of an inner furnace enclosure.

While the desirability of utilizing costly, high technology castable refractory materials to form bases of annealing furnaces also has been recognized, efforts that have been made to mold-form these cantankerous materials in situ at the sites of an annealing furnaces have not met with good success. The type of cast refractory materials that are available at present-day that can be mold-formed to provide rigid ceramic structures that will withstand use in a steel production facility where temperatures are repeatedly cycled between ambient temperature and temperatures of up to about 1500 degrees Fahrenheit (and above) are low cement containing mixtures that include about 45 to about 47 percent alumina ($Al_2O_3$), about 45 to 47 percent silica ($SiO_2$), and that contain about 2 percent, by weight, of thin stainless steel needles (that typically are about an inch in length and are included to provide strength and reinforcement to the resulting product)—which are mixed with a sufficiently small quantity of water to barely bring the material to a dry granular consistency that can be fed into a mold without causing a cloud of dust to arise as the mix is fed into the mold, and which require the presence of power-induced mold vibration in order to ensure that the material is properly distributed throughout the mold to form a mixture of even consistency that can be cured to form a strong, temperature-cycle-resistant product.

To achieve the uniformity and high density of refractory material that is needed in the resulting product, it is important that the water content of a cast refractory mix be carefully controlled and kept to a minimum, that the vibration that is applied to the mold be sufficiently powerful to thoroughly vibrate the mold for substantially the entire period of time that the mold is being filled, and that the newly molded product be carefully cured in a temperature controlled environment—little, if any, of which tends to be properly carried out if what one tries to do is to mold an annealing furnace base in situ at a furnace site.

Forming cast refractory members to provide components of annealing furnace bases has even proved to be a difficult undertaking to carry out in a specialized cast refractory production facility due to the enormous size and weight of the members that need to be formed, and due to the massive amounts of cast refractory material that need to be aggressively vibrated into place in massive molds or forms. If base components are made that are too small in size, the number of components that must be installed, the nature of the mistakes that can be made in installing components, and problems of component breakage unduly complicate the work of effecting full-base replacements. On the other hand, the larger that components are made, the heavier they are to move, the more difficult they are to properly position, and the less forgiving they are of accommodating dimensional irregularities that are encountered to some degree in almost every base replacement endeavor. Finding a "right approach" to the sizing and shaping of remote-facility-molded cast refractory segments for annealing furnace bases has proved to be elusive.

While efforts have been made to mold whole furnace bases and base portions off-site at facilities that specialize in the fabrication of mold-formed castable refractory structures by mold-forming castable refractory materials, such efforts have met with very differing degrees of success depending often on the extent to which success can be had in transporting the resulting structures to, and in crane-lifting such structures into place at, a furnace site. Trying to use lift truck forks to maneuver cast refractory structures, and trying to lift and position cast refractory structures utilizing crane-supported cables that wrap about or otherwise engage outer surfaces of the newly molded cast refractory structures tends to cause unacceptable chipping, cracking and breakage. Moreover, incorrectly stressing or inadequately supporting these massively heavy cast structures during transport or during lifting or positioning, can easily cause the newly cast structures to break apart under their own weight.

Thus, while the desirability of forming cast refractory annealing furnace bases has been recognized, the need for a practical method that will actually enable cast refractory bases of high structural integrity and offering reliably good performance characteristics to be provided and installed with excellent consistency has gone unfulfilled.

Another problem that has been encountered with annealing furnace bases is the Severe warping and cracking of, and hence the need for frequent replacement of, structural steel that typically is welded in place in the vicinities of the inner or outer seals of the furnace. Inner walls of the outer seal troughs of annealing furnaces have, for example, typically been formed from structural steel that is held in place by virtue of being welded to an underlying base support structure of the furnace; and this structural steel often is found to warp severely and to break loose from its welds long before the service life of an adjacent cast ceramic base has come to a close.

Because structural steel does not fare well when subjected to repeated cycling between ambient temperature and elevated temperatures within the range of about 1500 degrees Fahrenheit (and above), and because welds of structural steel also perform poorly when subjected to repeated temperature cycles of this type, it has been recognized as being desirable to eliminate or minimize the use of structural steel and structural steel welds in the vicinities of the inner and outer seals of annealing furnaces. However, it has been widely accepted that cast refractory materials do not have sufficient strength and sufficient impact resistance to be used either in place of such structural steel or in reinforcing welded steel structures that may need to be used to define the outer seal trough of an annealing furnace. Some of the features of the present invention break new ground in successfully employing cast refractory materials in unconventional uses of this type.

Because the base structures of annealing furnaces are subjected to repeated cycles of high temperature heating followed by cooling, and because heavy loads are imposed on these structures as both massive charges of metal and heavy furnace enclosures are moved into and out of position, annealing furnace base structures need to be serviced and repaired frequently, and replaced regularly as a part of scheduled programs of maintenance—which is true regardless of the character of the materials from which the bases are formed.

Plural-stack annealing furnace bases are so large in size and so heavy in weight that it has long been considered impractical, if not impossible, to assemble these structures at a remote facility, and to then transfer the assembled structures to, and install the assembled structures at, a plural-stack furnace site. Especially if sizable cast refractory components are utilized in forming a plural-stack base, it essentially has been "accepted" that the size and weight of an assembled plural-stack base, combined with the minimal capability that cast refractory components have to withstand deformation, prohibits the assembly at and transfer from a remote facility of a plural-stack annealing furnace base that can be installed as an assembled, ready-to-operate unit. Accordingly, replacement of plural-stack annealing furnace bases has tended to consume sizable amounts of furnace "down time" due the perceived "requirement" that base assembly be carried out in situ at the furnace site.

Far too much "down time" presently is needed to maintain, repair and replace the bases of plural-stack annealing furnaces. Bases are needed, and base maintenance, repair and replacement tools and techniques are needed, that will permit the maintenance, repair and replacement of annealing furnace bases to be carried out while requiring much less "down time."

3. The Referenced Cases

The referenced Cast Refractory Segment Cases disclose a number of annealing furnace base segment configurations that can be used in conjunction with features of the preferred practice of the present invention. The referenced Companion Case discloses a preferred manner in which features of the present invention, together with other invention features, are put to use in the environment of a single stack annealing furnace. Due to the related nature of these referenced cases, their disclosures are incorporated herein, by reference.

SUMMARY OF THE INVENTION

The present invention addresses the foregoing and other needs and drawbacks of the prior art by providing a number of novel and improved features, some of which are capable of being used with existing forms of plural-stack annealing furnace bases, but many of which are preferably and most advantageously used in combination to provide an improved plural-stack annealing furnace base that is characterized by excellent longevity of service, by reliable and lengthy inner seal performance, and by the utilization of modular components that can be maintained, repaired and eventually replaced with relative ease and convenience, and with minimal furnace "down time."

A significant aspect of the preferred practice of the present invention relates to the provision of a set of cast refractory and modular fiber seal components for a plural-stack annealing furnace base that lend themselves quite nicely to either of two modes of base assembly: namely, 1) to being transported to a furnace site in modular form (i.e., as a set of unassembled components) for being assembled at the furnace site, or 2) to being fully assembled to form a furnace base at a remote, "off-site" location, and then being transported to and final-positioned at a furnace site as a fully assembled unit.

If on-site assembly is elected, such portions of an existing welded steel base support structure of an annealing furnace as may need to be repaired or replaced are attended to, or a new welded steel base support structure is provided and is lifted into position. Atop the base support structure, an initial blanket of refractory fiber material is laid in place; cast refractory segments of the new base are installed side by side atop the initial blanket; and a novel set of inner seal components that embody features of the invention is installed in inner seal positioning troughs of tapered cross-section that are defined between inner and outer segments of the cast refractory base, as will be described later herein. Methods by which a plural-stack annealing furnace base is assembled and installed on-site utilizing a novel set of modular components also constitute features of the present invention.

If off-site assembly is elected, a new welded steel base support structure is provided; an initial blanket of fiber refractory together with cast refractory segments and the novel modular-segment inner seal assembly are installed; and the fully assembled base is trucked to the furnace site to be lifted in place as soon as an existing base and its debris are cleared away. If off-site assembly is utilized, the new base support structure preferably is provided with upstanding lift connection arms that are strategically located to permit the fully assembled plural-stack base lifted from a transport vehicle and final positioned at the installation site without causing damage to the assembled segments—whereafter the upstanding arms can be cut off utilizing a cutting torch, if desired. Tools and techniques that preferably are employed when a plural-stack annealing furnace base is assembled off-site utilizing modular components, and is lifted from a truck and installed at a furnace site also constitute features of the present invention.

A significant feature of the preferred practice of the present invention has to do with the provision of a novel set of elongate fiber seal modules of compressed, reinforced fiber refractory material that preferably are utilized in combination with a set of spacer blocks of fiber refractory material and a pair of elongate blankets of fiber refractory material to form at least the inner seals of the base of a plural-stack an annealing furnace, it being understood that the outer seal of the furnace also can be formed utilizing substantially the same components. The use of compressed, reinforced fiber refractory modules together with other fiber refractory components to form inner seals that will retain needed resilience during a lengthy service life while also providing a capability to properly support the heavy inner enclosures of the furnace represents a significant advance in the art.

Another feature of preferred practice has to do with techniques that are used to tightly pack the novel fiber seal modules end-to-end and downwardly into the upwardly opening inner seal positioning troughs that are defined between the inner and outer cast refractory base segments to form particularly effective inner seals that have been found to perform exceptionally well during suitably lengthy service lives. Tests have shown that a typical inner seal formed in accordance with the preferred practice of the present invention will permit an inert gas pressure of 5 ounces per square inch (above ambient air pressure) to be maintained in a treatment chamber—which is about five times the gas pressure that typically has been reliably attainable and maintainable with previously proposed seals that make use of some form of fiber refractory. The seal installation techniques that have been developed that permit use of compressed, reinforced fiber modules together with spacer blocks and a set of upper and lower blankets of fiber refractory to define a much improved seal also represent a significant step forward in the art.

Still another feature of the preferred practice of the present invention relates to techniques and tools that preferably are utilized to maintain and rejuvenate the fiber seal assemblies of a plural-stack base to ensure that the seal assemblies perform well during the course of lengthy service lives. In preferred practice, each of the trough-carried, tightly packed, end-to-end arrangements of fiber seal modules is sandwiched between an overlying upper blanket of fiber refractory material, and an underlying lower blanket of refractory fiber material, with the upper blanket being replaced from time to time as part of an ongoing program of scheduled maintenance. The seal is rejuvenated from time to time by utilizing a special compression and shaping tool that simultaneously engages the full circumferential length of the upwardly facing surface of the seal 1) to press-shape the top surface of the seal, and 2) to ensure that all components of the seal are properly pressed down into the enclosing trough so that the seal will properly receive and make sealing engagement with the bottom rim of an inner enclosure when an inner enclosure is lowered into seated engagement with the seal.

The seal compression and shaping tool also is used beneficially during seal installation, repair and replacement. Fiber seal installation, rejuvenation, maintenance and replacement techniques that preferably are utilized to achieve good fiber seal performance and to maintain good seal performance throughout a lengthy service life also constitute aspects of the present invention.

In accordance with another feature of preferred practice, a plural-stack base is provided with upwardly opening inner seal positioning troughs, each having a cross-section that narrows with trough depth, with the troughs being defined between inner and outer members of a novel set of cast refractory segments that form a rigid ceramic refractory base of the furnace. Inner segments of the cast refractory base define one of two opposed sides of each of the inner seal positioning troughs; outer segments define the other; and the segment surfaces that define opposite sides of each trough preferably provide trough cross-sections that narrow with depth to assist in maintaining a tight fit with refractory fiber components of the inner seals as these components tend to be pressed downwardly into the troughs by the weight of inner enclosures of the furnace seated atop the inner seals. The use of a set of inner and outer cast refractory segments to define tapered inner seal positioning troughs that aid in keeping the inner seals tightly in place in the troughs throughout their service lives also constitutes a significant feature of preferred practice.

Another aspect of preferred practice relates to the provision of a plural-stack annealing furnace base that utilizes a novel set of inner and outer cast refractory segments to form a rigid ceramic refractory base, with the outer segments of the base having hard, wear and impact resistant, pre-cast refractory inserts integrally anchored to adjacent portions of the cast refractory outer segments for defining furnace-enclosure engageable surfaces that will withstand the sometimes base-damaging types of contacts and impacts that normally are encountered during furnace enclosure movements.

Still another feature of preferred practice resides in the ease with which the basic plural-stack design 1) can be adapted to accommodate the use of conventional structural steel adjacent the location of the outer seal of the base, or 2) can substitute for conventional structural steel improved cast refractory outer base components that have hard, wear and impact resistant, pre-cast ceramic "inserts" for bordering the inside surface of an outer seal groove to be engaged by a furnace enclosure that is being positioned for use, that are integrally connected to the outer base components at the time the outer base components are mold formed, and that provide needed outer seal border structure that will serve the required function without warping, cracking and otherwise experiencing the significant kinds of problems that are encountered with the use of a structural steel outer seal border. Methods of forming outer segments of a plural-stack base assembly to incorporate hard, wear and impact resistant, pre-cast ceramic inserts also comprise aspects of the preferred practice of the present invention.

Still another feature of the present invention resides in the provision of a plural-stack base assembly design that easily can be adapted for use with either conventional outer seals that typically are formed using sand, or that can incorporate steel structure that is anchored to cast refractory outer segments when these segments are mold-formed, with the refractory-anchored steel structure defining an outer seal groove for mounting a compressed, fiber refractory outer seal formed from modules in substantially the same manner that the above-described inner seal is formed. Methods of fabricating and assembling cast refractory outer segments that have steel structure anchored thereto for defining an outer seal groove, and of utilizing compressed refractory fiber modules in conjunction with outer cast refractory sections to form an outer seal of a plural-stack base assembly also constitute aspects of the present invention.

In accordance with still another feature, installation, removal and replacement of the cast refractory segments is facilitated by providing each and every one of the cast refractory segments with three lift engageable formations that are anchored securely into the cast refractory material of each segment, and that can be connected to a three-armed lifting fixture that is designed to support the cast refractory segments in horizontally extending attitudes as the segments are positioned and installed with the aid of a crane. This combination of a triumvirate of segment-anchored lift connections and the use of a three-arm lifting fixture obviates the need to wrap cables about, or to otherwise bring lifting devices directly into contact with outer surfaces of cast refractory segments, and provides a means by which segments can be final positioned without having to be pried into place or otherwise man-handled in ways that might detrimentally affect the integrity of the cast segments.

Another aspect of the preferred practice of the present invention relates to the provision of a plural-stack base assembly that is comprised of components which permit a complete base unit to be remotely assembled atop the flat bed of a transport truck in a facility that may not have crane capacity that is sufficient to lift more than the weight of the heaviest major component that is utilized in forming the assembled base. A further aspect has to do with a preferred form of lifting fixture that permits a massively heavy, fully assembled plural-stack base to be lifted from a flat bed truck and put into place at a steel mill where heavy crane lift capacity normally is present. Methods by which modular base segments are assembled at a remote facility that may have only limited crane lift capacity, and are transported to and installed at a furnace site utilizing a transport vehicle on which a base unit has been assembled also constitute aspects of the invention.

BRIEF DESCRIPTION OF THE DRAWINGS

Other features and a fuller understanding of the invention may be had by referring to the following description and claims taken in conjunction with the accompanying drawings, wherein:

FIG. 5 is a perspective view, on an enlarged scale, illustrating somewhat schematically, how cube-shaped blocks of refractory fiber insulation can be cut from a log of refractory fiber insulation for use in forming fiber seal modules;

FIG. 6 is an exploded perspective view depicting selected components of a fiber seal module of the type that preferably is utilized form at least the inner seals that are employed in plural-stack annealing furnace bases in accordance with the preferred practice of the present invention;

FIG. 7 is a perspective view of an assembled one of the fiber seal modules;

FIG. 8 is an exploded perspective view illustrating fiber seal modules, spacer blocks and a pair of upper and lower blankets of refractory fiber insulation that preferably are utilized in forming inner seals in plural-stack annealing furnace bases;

DESCRIPTION OF THE PREFERRED EMBODIMENT

Figure 1:
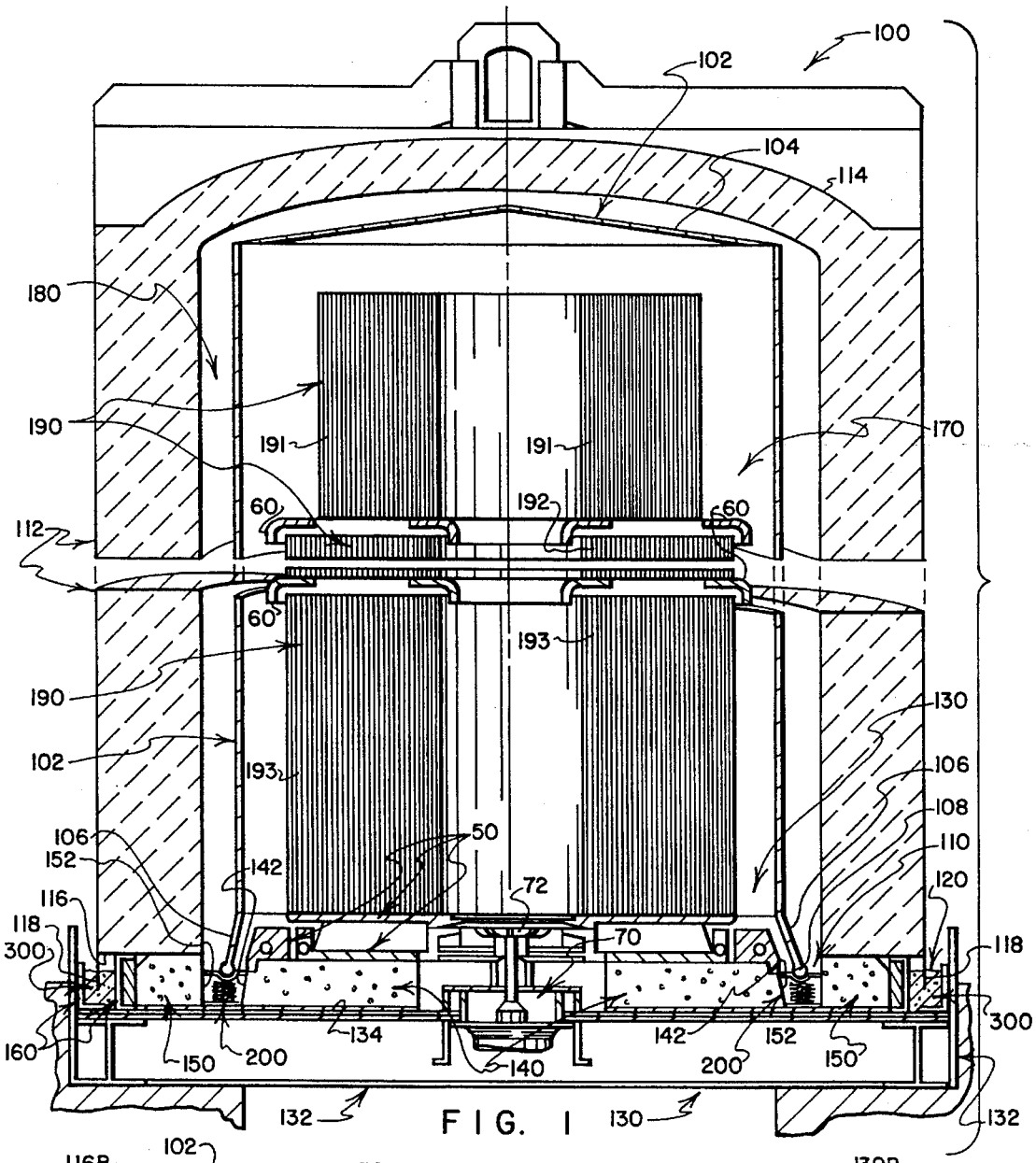
FIG. 1 is a foreshortened vertical cross-sectional view depicting portions of a typical stack of a plural-stack annealing furnace that has cast refractory base segments and a modular fiber seal system forming an inner seal that embody features of the preferred practice of the present invention.

Referring to FIG. 1, an annealing furnace that incorporates novel and improved base features representing the preferred practice of the present invention is indicated generally by the numeral 100. While the furnace 100 is of the plural-stack type, only a typical one of the stacks of the furnace 100 is depicted in FIG. 1.

As those who are skilled in the art will readily appreciate, a so-called "plural-stack" annealing furnace typically has two to four "stacks" that are served by a common base, with each of the stacks having a separate, generally cylindrical inner enclosure of the type that is shown in cross-section and is indicated generally by the reference numeral 102 in FIG. 1, and having a much larger, generally rectangular outer enclosure, shown in cross-section in FIG. 1 and indicated by the numeral 112, which surrounds all of the closely spaced inner enclosures 102. While features of four-stack annealing furnace bases are described and depicted herein, it will be understood that features of the invention are not limited to use with annealing furnaces having precisely four side by side stacks.

Except for the novel and improved base features that will be described shortly, the furnace 100 preferably is of the general type that has its structure and operation described in detail in the following patents of Gary L. Coble, referred to hereinafter as the "Annealing Furnace Patents," the disclosures of which are incorporated herein by reference, namely: 1) DIFFUSER SYSTEM FOR ANNEALING FURNACE, U.S. Pat. No. 4,516,758 issued May 14, 1985; 2) DIFFUSER SYSTEM FOR ANNEALING FURNACE WITH WATER COOLED BASE, U.S. Pat. No. 4,611,791 issued Sep. 16, 1986; 3) METHOD OF ANNEALING USING DIFFUSER SYSTEM FOR ANNEALING FURNACE WITH WATER COOLED BASE, U.S. Pat. No. 4,755,236 issued Jul. 5, 1988; and, 4) DIFFUSER SYSTEM FOR ANNEALING FURNACE WITH CHAIN REINFORCED, NODULAR IRON CONVECTOR PLATES, U.S. Pat. No. 5,048,802 issued Sep. 17, 1991.

While the furnace 100 will be understood to provide a plurality of stacks, the stacks are arranged closely side by side in an "in-line" array, and all have substantially the same appearance when viewed in cross-section. For this reason, the cross-sectional view that is presented by FIG. 1 and which shows only one of the stacks of the furnace 100 will serve nicely to accompany the description that is provided herein of a typical annealing furnace stack, and the brief explanation that is provided herein of the manner in which an annealing furnace typically is operated.

Referring to FIG. 1, the furnace 100 includes a conventional, generally cylindrical inner enclosure 102 that is surrounded by a generally rectangular outer enclosure 112. The enclosures 102, 112 have closed upper ends 104, 114 and open lower ends 106, 116, respectively. The inner enclosure 102 has a depending rim formation 108 that extends into an upwardly opening inner seal trough 110. The outer enclosure 112 has a depending knife edge formation 118 that extends into an upwardly opening outer seal trough 120.

Figure 2:
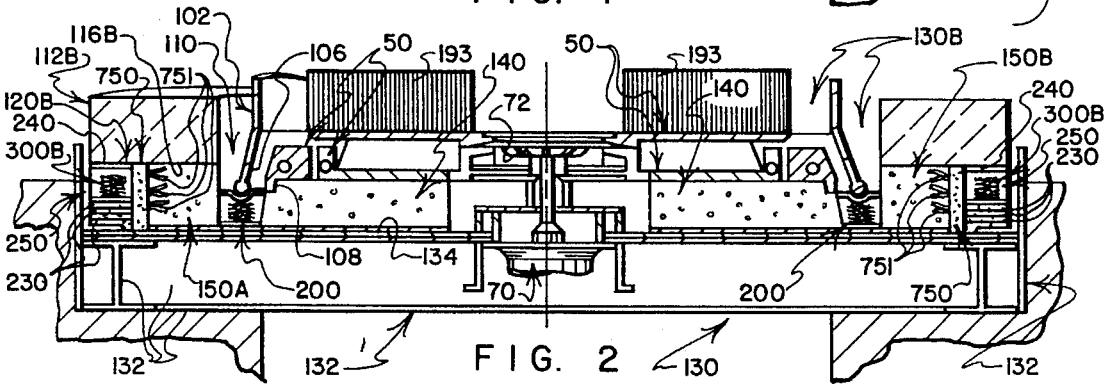
FIG. 2 is a vertical cross-sectional view of lower portions of a typical stack of an alternate embodiment of a plural-stack annealing furnace that employs the modular fiber seal system of the present invention to form both inner and outer seals, and that utilizes hard, wear and impact resistant, pre-cast ceramic refractory inserts that are anchored to the cast refractory material of outer segments of a cast refractory base of the furnace to line at least selected portions of an outer seal trough.
Figure 13:
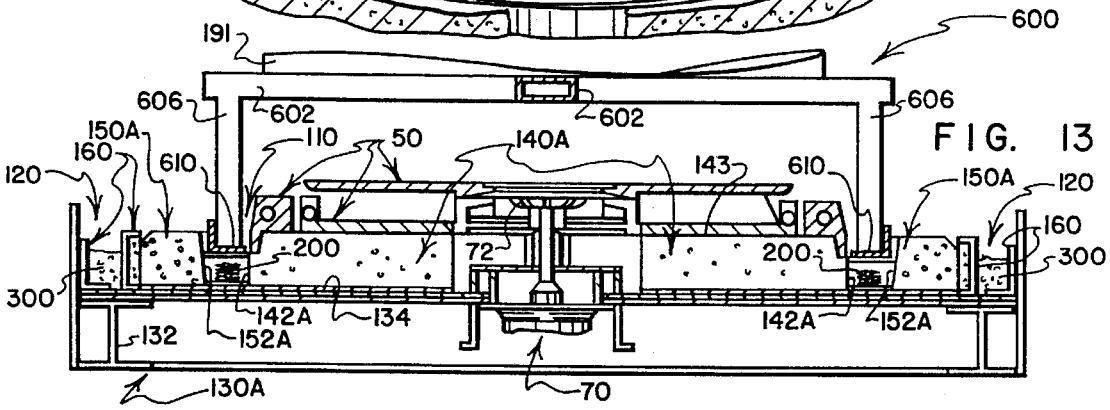
FIG. 13 is a sectional view that shows features of an alternate form of base that embodies features of the present invention, with the tool of FIG. 11 seated atop the inner seal of the base.

Also disclosed herein are two alternate forms of annealing furnace bases that disclose a variety of modifications that can be selectively utilized, as desired. In FIG. 13, a furnace base 300A is depicted that utilizes a different arrangement of cast refractory surfaces than is utilized in the furnace base 300 of FIGS. 1 and 3 to provide an inner seal trough 110A that narrows with depth. In FIGS. 2 and 4, a furnace base 300B is depicted that: 1) utilizes features of the novel fiber seal system of the present invention to form not only inner seals 200B but also the outer seal 300B of the furnace; 2) employs hard, wear and impact resistant, pre-case ceramic refractory inserts 750 that are anchored to the cast refractory material from which outer segments 154B, 155B of the cast refractory base of the furnace are formed to provide a durable refractory border for an outer seal trough 120B of the furnace; and, 3) utilizes a modified form of outer segments 154B, 155B together with a metal dividers 325 that segregate adjacent inner seal troughs 110B to accommodate a furnace embodiment that has its stacks more closely spaced than does the furnace of FIGS. 1 and 3.

Figure 3:
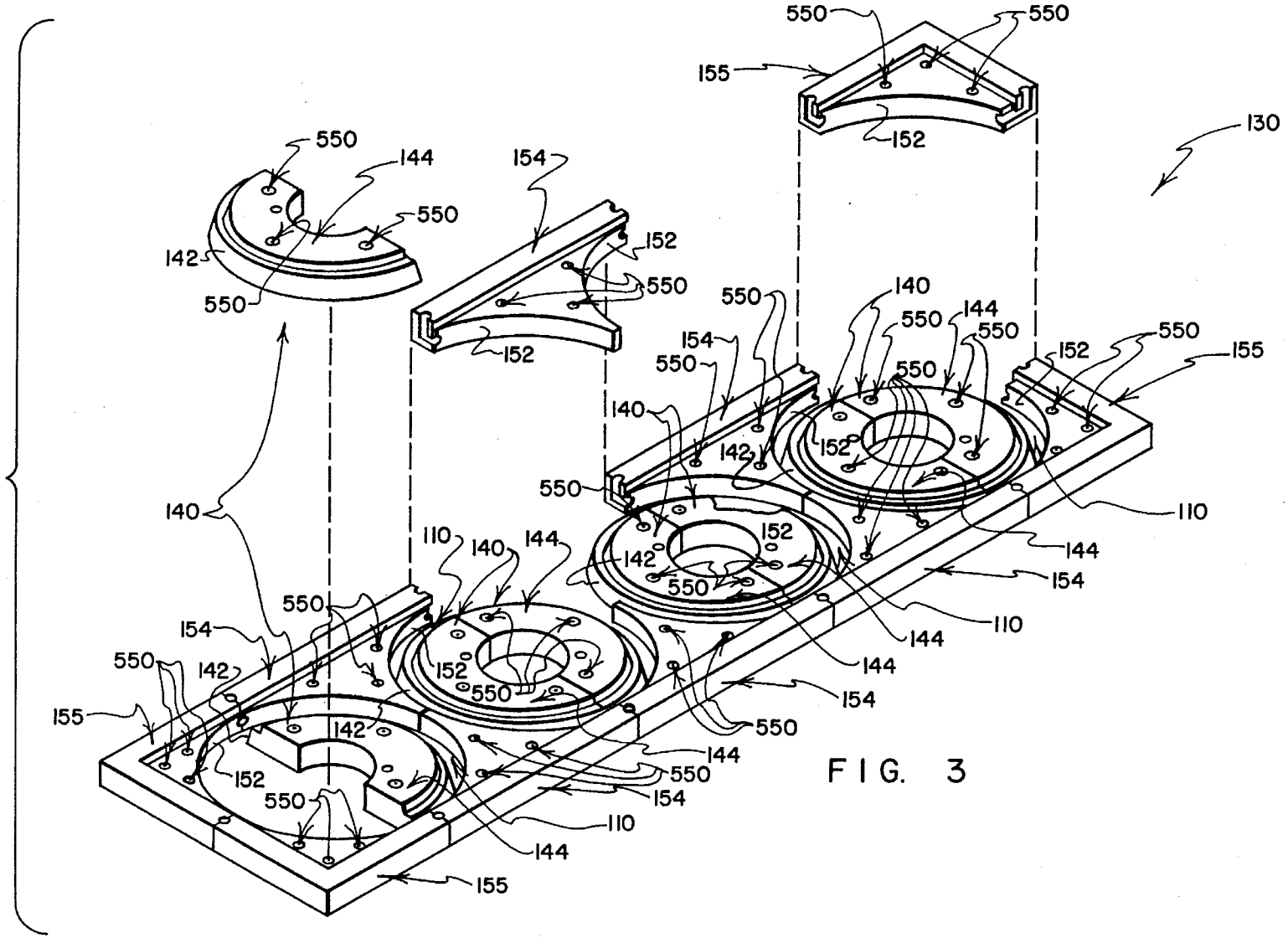
FIG. 3 is an exploded perspective view depicting inner and outer cast refractory base segments that are utilized in the base of the furnace of FIG. 1, with some of the segments shown side-by-side in their assembled configuration, and with some segments being raised or having portions thereof broken away to permit selected features to be better viewed.
Figure 4:
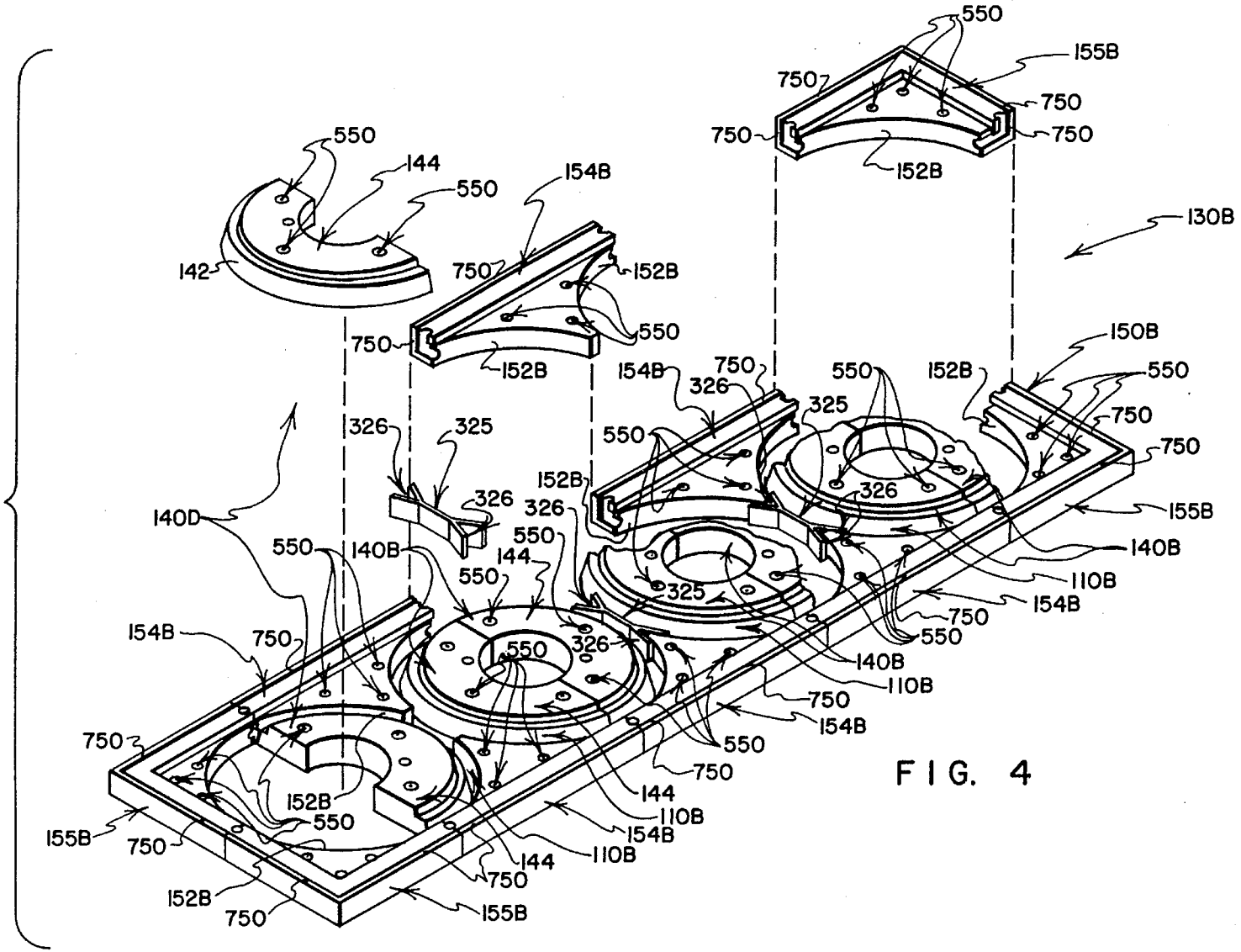
FIG. 4 is an exploded perspective view depicting inner and outer cast refractory base segments that are utilized in the base of the furnace of FIG. 2, it being noted that this furnace embodiment has its treatment chambers more closely spaced than does the furnace of FIGS. 1 and 3.

Because the furnace bases 130, 130A and 130B that are depicted in FIGS. 1 and 3, in FIGS. 2 and 4, and in FIG. 13, respectively, have much in common, a system of similar reference numerals is utilized in the drawings to depict similar features. Reference numerals that are "identical" are utilized in FIGS. 1–4 and 13 to designate features and components that are "identical." Components of the base 130A shown in FIG. 13 that differ a bit in configuration from the components of the base 130 shown in FIGS. 1 and 3 are indicated by reference numerals that "correspond" to those used in FIGS. 1 and 3 except for the addition thereto of the letter "A." Components of the base 130B shown in FIGS. 2 and 4 that differ a bit in configuration from the components of the base 130 shown in FIGS. 1 and 3 are indicated by reference numerals that "correspond" to those used in FIGS. 1 and 3 except for the addition thereto of the letter "B."

Returning to FIG. 1, the inner seal trough 110 contains an inner seal 200 that, together with the inner trough 110, extend substantially concentrically about a generally circular, cast refractory "inner base structure" 140. As is best seen in FIG. 3, the inner base structure 140 that underlies each of the four stacks of the furnace 100 comprises a set of two generally C-shaped cast refractory "inner segments" 144. In preferred practice, all eight of the C-shaped inner segments 144 utilized in forming all four of the inner base structures 140 are identical one with another, and are therefore interchangeable. When each pair of the C-shaped inner segments 144 are positioned side by side to form one of the inner structures 140 of one of the stacks of the furnace 100, such narrow space as may remain open between adjacent opposite ends of the segments 144 of each of the sets 140 preferably are filled with refractory mortar (not shown) so that the resulting inner base structures 140 extend endlessly and continuously in ring-like, annular form.

The outer seal trough 120 contains an outer seal 300 that, together with the trough 120 extends about the generally rectangular perimeter of the an "outer base structure" 150. Referring to FIG. 3, the outer base structure 150 that extends about the inner structures 140, in spaced relationship thereto, comprises a set that includes "side" and "corner" segments 154, 155. Six side segments 154 are employed that are identical one with another, and are therefore interchangeable. Four corner segments 155 are employed that are identical one with another, and are therefore interchangeable. The corner segments 155 are deployed in pairs at opposite ends of the outer base structure 150. The side segments 154 are deployed in a group situated between the two pairs of corner segments 155. When each pair of the side and corner segments 154, 155 are final-positioned to extend side by side in a common plane in the manner in which the majority of these segments are depicted in FIG. 3, such narrow spaces as may remain open between adjacent surfaces of adjacent pairs of segments preferably are filled with refractory mortar (not shown) so that the resulting outer base structure 150 extend endlessly and continuously to ring each of the four sets of inner structures 140.

Referring to FIGS. 2 and 4, cast refractory segments of the furnace base 130B include side segments 154B and corner segments 155B that cooperate to define inner and outer base structures 140B, 150B, in much the same manner that the side and corner segments 154, 155 of the furnace base 130 define inner and outer base structures 140, 150, as is depicted in FIGS. 1 and 3. However, a difference between the furnace bases 130, 130B that is appropriate to point out at this stage of the description has to do with the manner in which the furnace base 130B accommodates an arrangement of annealing stacks that are more closely spaced than are the furnace stacks that are served by the furnace base 130. In the furnace base 130 of FIGS. 1 and 3, opposed pairs of the side segments 154 have center portions that extend into juxtaposition to fully segregate each of the adjacent pairs of inner seal troughs 110 from each other. In the furnace base 130B of FIGS. 2 and 4, however, adjacent pairs of stacks of the furnace are so closely spaced that adjacent pairs of inner seal troughs 110B have outer borders that intersect; and, opposed pairs of the side segments 154B have center portions that terminate at spaced-apart locations. To provide dividers between adjacent ones of the inner seal troughs 110B, elongate steel separators 325 that have "Y" formations 326 on opposite ends thereof are installed between the spaced-apart center portions of opposed pairs of the side segments 154B, in a manner that is depicted in FIG. 4.

Returning to FIG. 1, the base structure 130 includes a welded steel "base support structure" 132, an upper part of which is defined by a steel plate 134 that underlies and supports the inner and outer base structures 140, 150. It is important that the plate 134 be substantially flat, and that the plate 134 be of good integrity. If the base structure 130 of an existing furnace is being rebuilt, it often will be necessary to replace the plate 134 to ensure that the cast refractory components that will be supported by the plate 134 will be properly supported throughout their service life.

Figure 19:
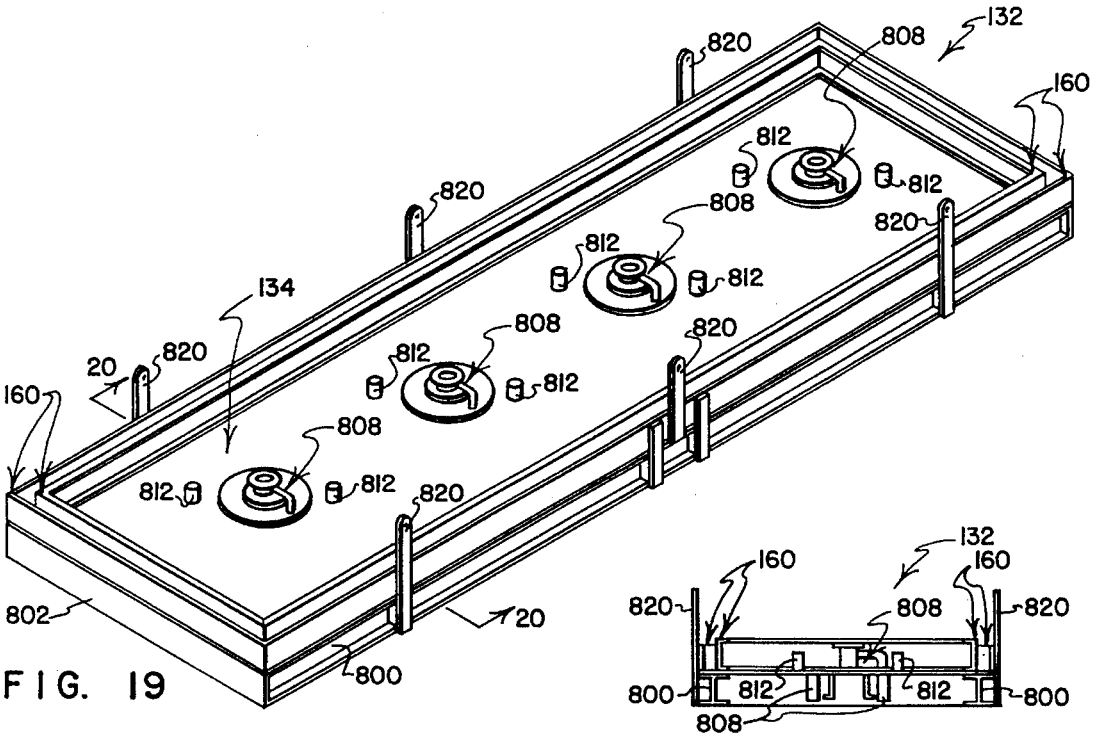
FIG. 19 is a perspective view showing principally top, front and left end portions of a welded steel base support structure for a plural-stack annealing furnace that can be fabricated off-site from the location of the furnace, it being understood that a view of the top, front and right end portions thereof would constitute a mirror image of FIG. 19.
Figure 20:
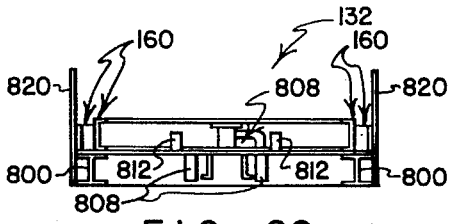
FIG. 20 is a sectional view thereof, as seen from a plane indicated by a line 20—20 in FIG. 19.
Figure 21:
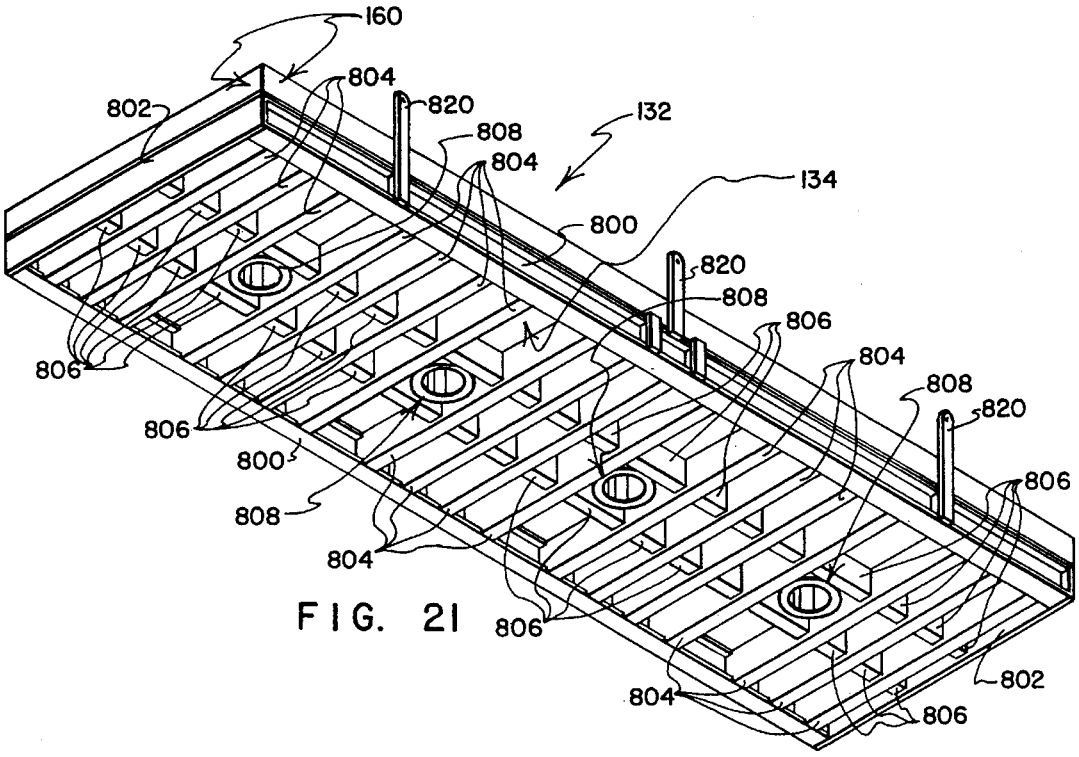
FIG. 21 is a perspective view showing principally bottom, front and left end portions of the base support structure of FIG. 19.

Referring to FIGS. 19–21, if a new base support structure 132 is to be provided for an existing furnace, it preferably will include a pair of widely spaced, relatively large I-beams 800 that extend along opposite side portions of the structure 132 between opposite ends thereof; a pair of end plates 802 that cap opposite ends of the I-beams 800 and extend transversely therebetween; a plurality of smaller structural steel members 804 that extend transversely between the I-beams 800 at spaced locations along the length of the structure 132; and other bracing and support members 806, as needed, to bridge between the transversely extending beams 804.

For a four-stack furnace, the plate 134 of the base support structure 132 will have four relatively large openings formed therethrough, through which suitable dome shaped enclosures 808 are provided to define four substantially equally spaced blower mount locations. Where pipe segments need to extend through the plate 134 (e.g., for such purposes as the feeding of gas to and/or from the environment of the treatment chamber 170, etc.), pipe segments 812 are inserted through appropriately positioned holes in the plate 134 and are welded to the plate 134.

Figure 24:
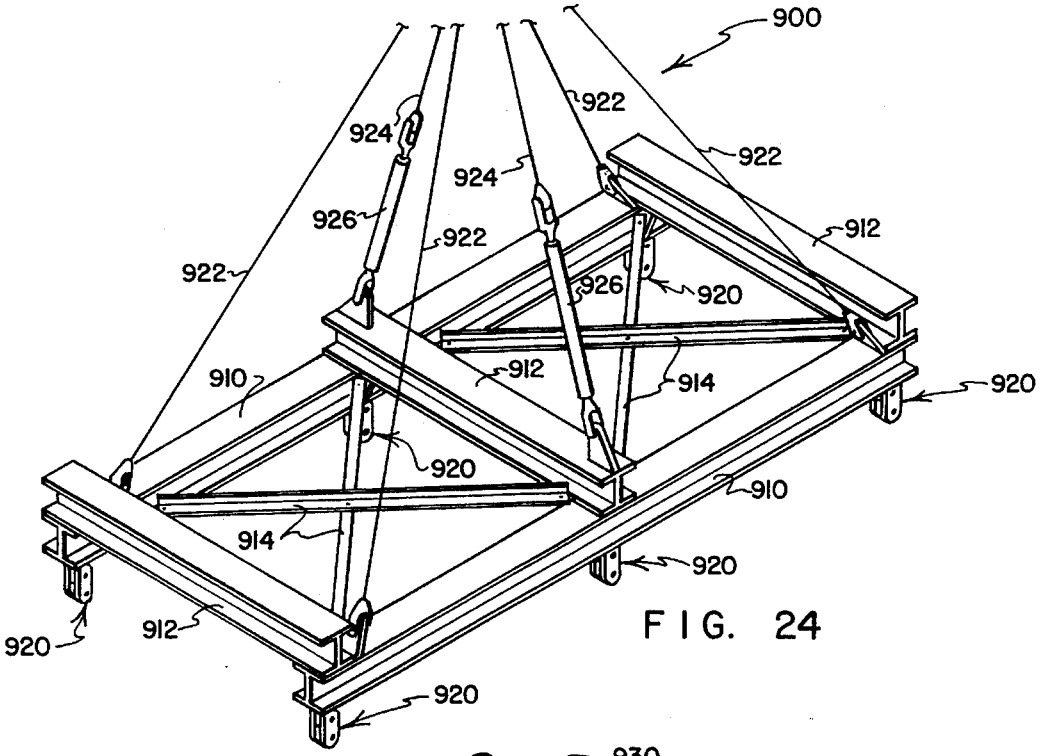
FIG. 24 is a perspective view depicting a six-connection, crane-supportable lifting fixture that preferably is utilized to connect the fully assembled plural-stack annealing furnace base to a crane during removal of the base assembly from the truck bed for installation at a furnace site; and, FIG. 25 is a side elevational view depicting the lifting fixture of FIG. 25 connected to a fully assembled plural-stack annealing furnace base as the base is lowered into position at a furnace site after being lifted from atop the flat bed of the semi-trailer.
Figure 25:
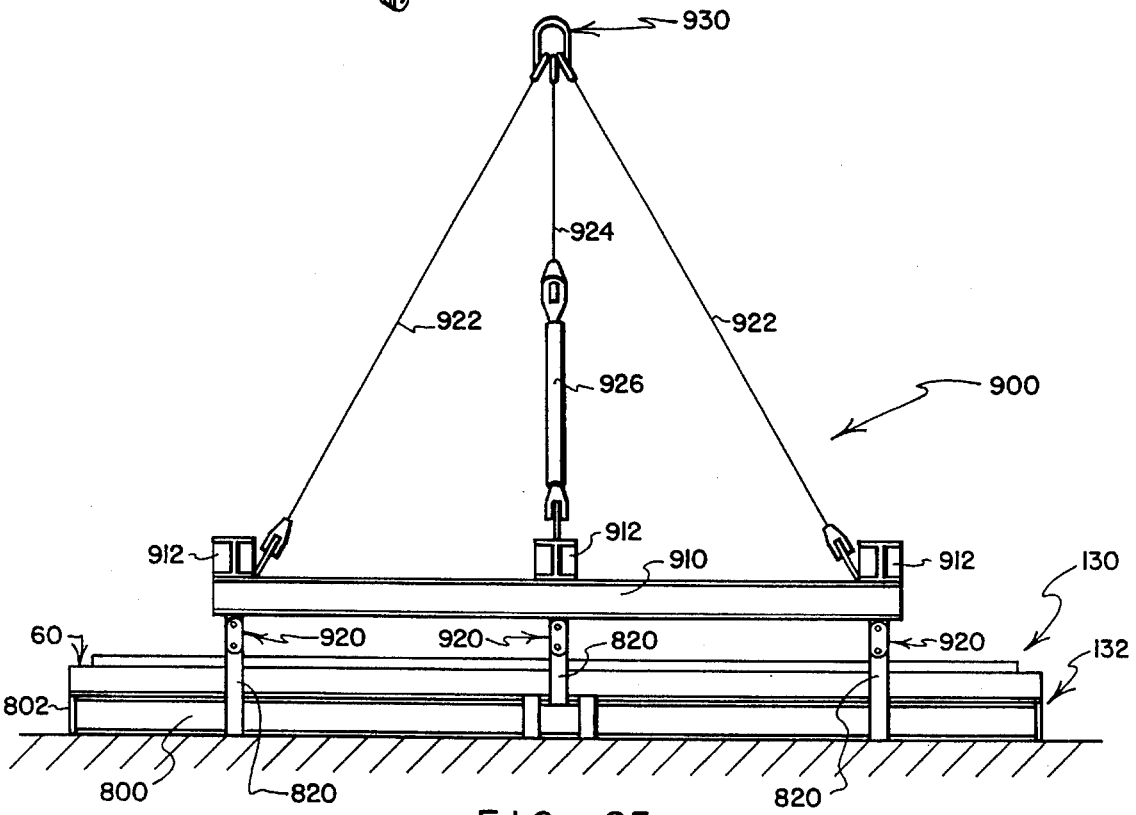

Continuing to refer to FIGS. 19–21, the steel members 160 that define opposite sides of the outer seal trough 120 are welded atop the plate 134 and extend along perimeter portions of the plate 134. Extending upwardly from, and welded securely to opposite sides of the base structure 132 at spaced locations along the opposite sides thereof, are six lift connection arms 820 that can be removably connected to a special six-connection lift fixture 900 that is depicted in FIGS. 24 and 25. When the six connection points 920 of the lift fixture 900 are connected to the lift arms 820, the base support structure 132 can be moved about by a crane (not shown) that is connected to a central cable connector 920 of the fixture 900. Once the base support structure 132 has been put in its final position at a furnace site, the lift arms 820 can be cut away utilizing a cutting torch (not shown) to ensure that the lift connection arms 820 do not interfere with movements of the outer enclosure 112 of the furnace 100.

Referring briefly to FIG. 24, the lift fixture 900 is a welded assembly that includes a pair of side beams 910, three transversely extending beams 912 that rigidly connect the side beams 910, and two pairs of cross braces 914 that assist in rigidifying the structure that is defined by the beams 910, 912. Two pairs of end cables 22 and a pair of central cables 924 connect with the side beams 910. The central cables 924 have adjustable turnbuckles 926 interposed therein to provide a means for adjusting cable loadings to ensure that loads are properly distributed among the cables 922, 924 to prevent deformation of the lift fixture 900 and of a base 130 that is carried by the lift fixture 900.

Figure 22:
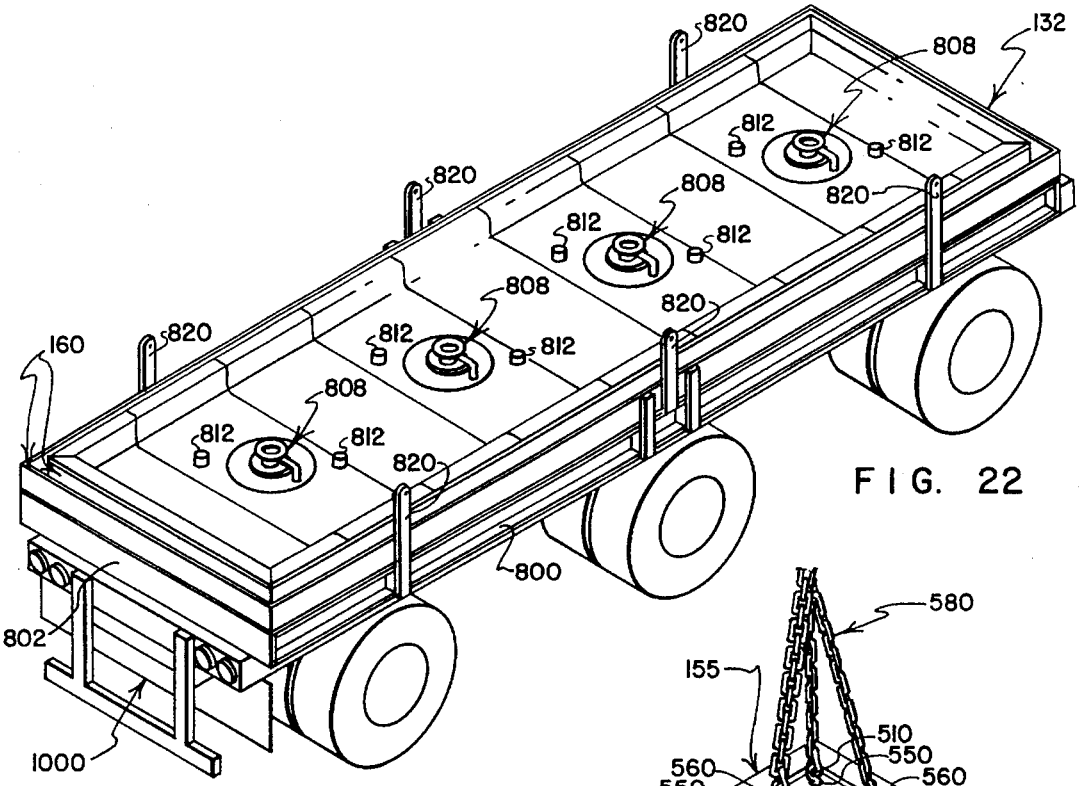
FIG. 22 is a perspective view showing the base support structure of FIGS. 19–21 positioned atop the flat bed of a conventional, plural-axle semi-trailer of the type that is typically coupled to the tractor of a semi-trailer truck for over-the-road transit, and showing an initial blanket of refractory fiber insulation material (comprised of strips of refractory fiber insulation laid side by side), installed atop portions of the base support structure, during an early stage of assembly of a complete base for a plural-stack annealing furnace.
Figure 23:
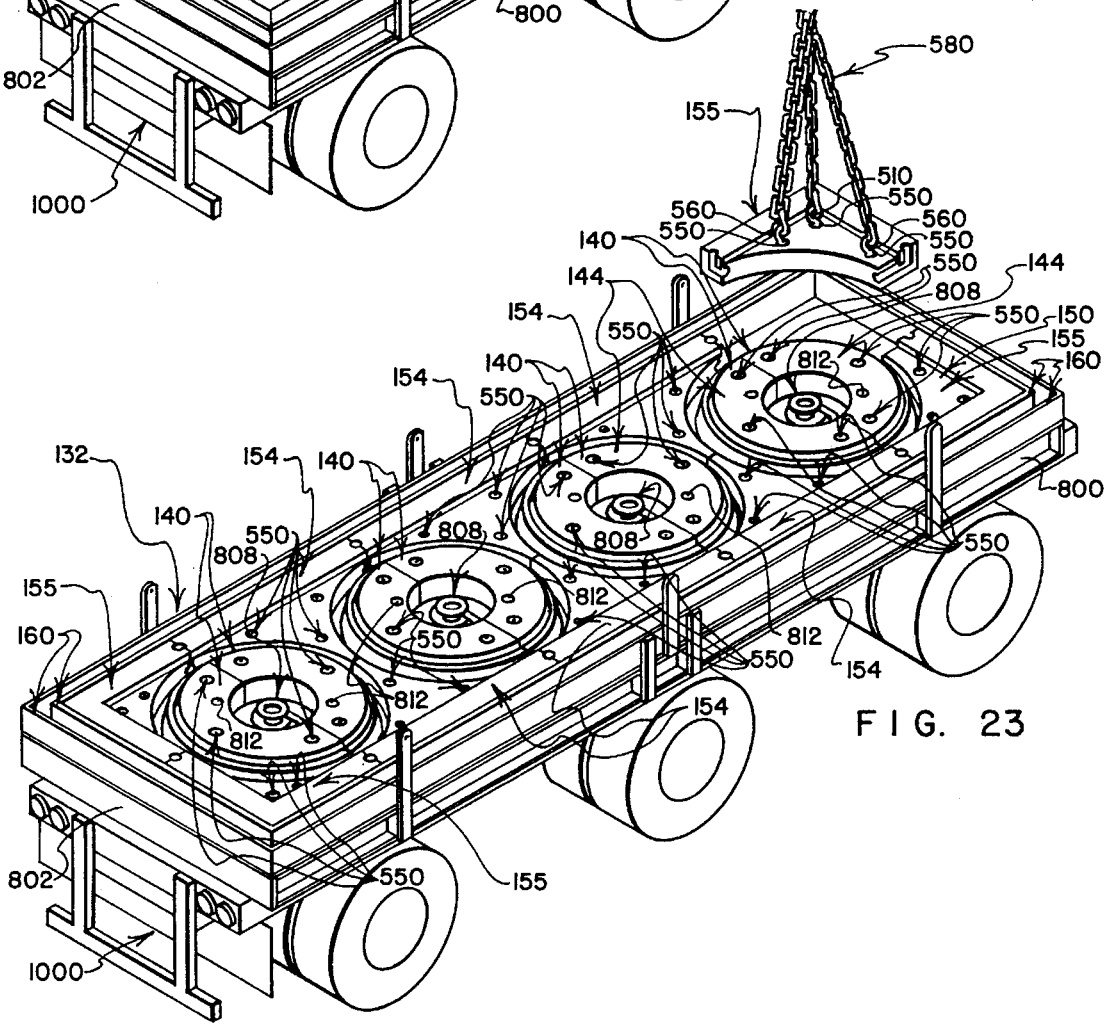
FIG. 23 is a perspective view similar to FIG. 22 depicting the accomplishment of additional steps in the process of assembling the complete base, with a final one of the cast refractory segments being crane-supported as during its movement toward a position where it will be installed.

Fabrication of the welded steel base support structure 132 preferably is carried out while the I-beams 800 are carefully supported, with both of the beams 800 being level so that, as the end plates 802, the transverse beams 804 and the like are welded in place, the resulting structure 132 will be flat and true. Once the structure 132 has been fully welded, it can be lifted (utilizing a crane and the lift fixture 900) onto the flat bed of a semi-trailer 1000, depicted in FIGS. 22–24, where remaining components of the base assembly 130 then can be installed.

Figure 9:
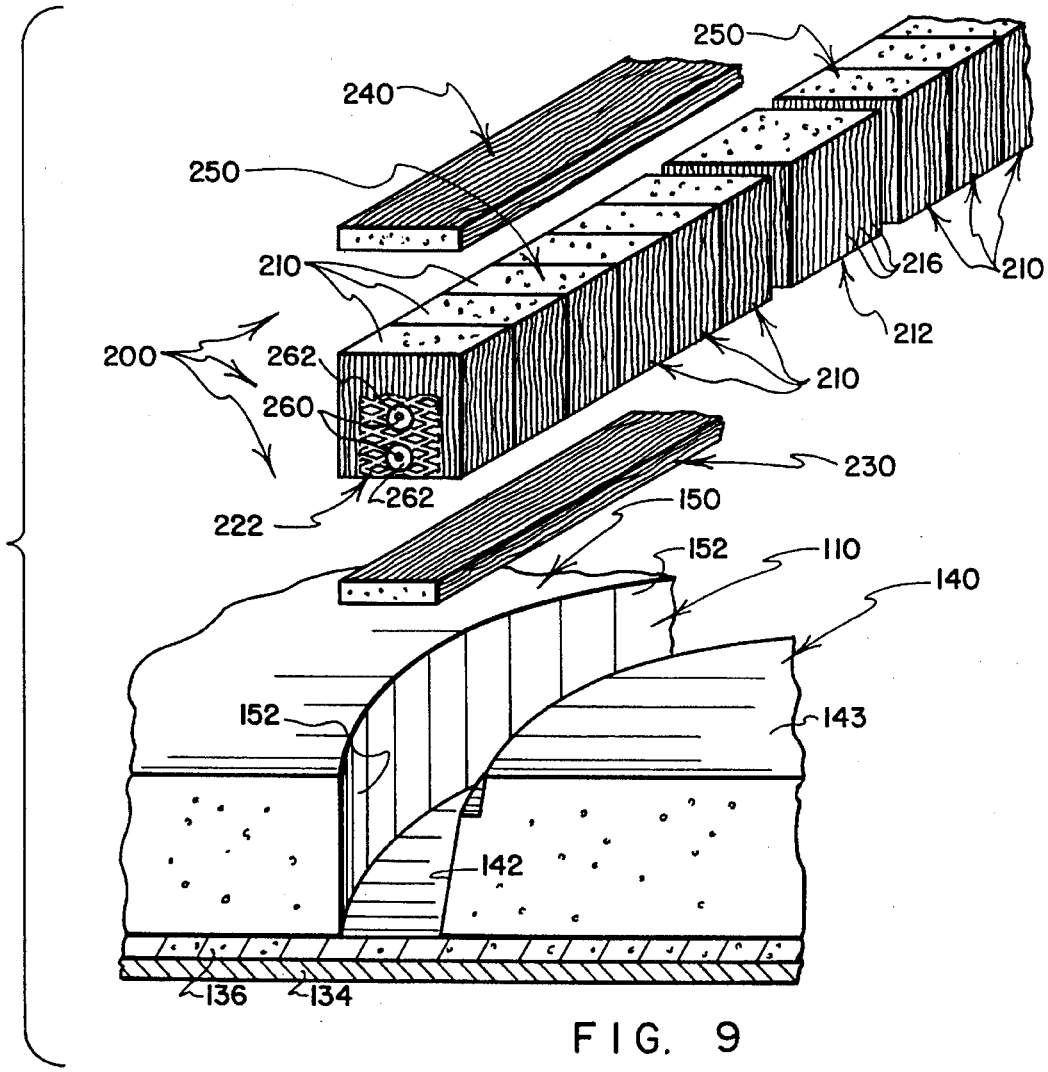
FIG. 9 is an exploded perspective view depicting on an enlarged scale portions of an inner seal positioning trough that is defined between inner and outer segments of the cast refractory base of the furnace of FIG. 1, and depicting selected components that preferably are utilized in forming a fiber seal within the inner seal trough.
Figure 10:
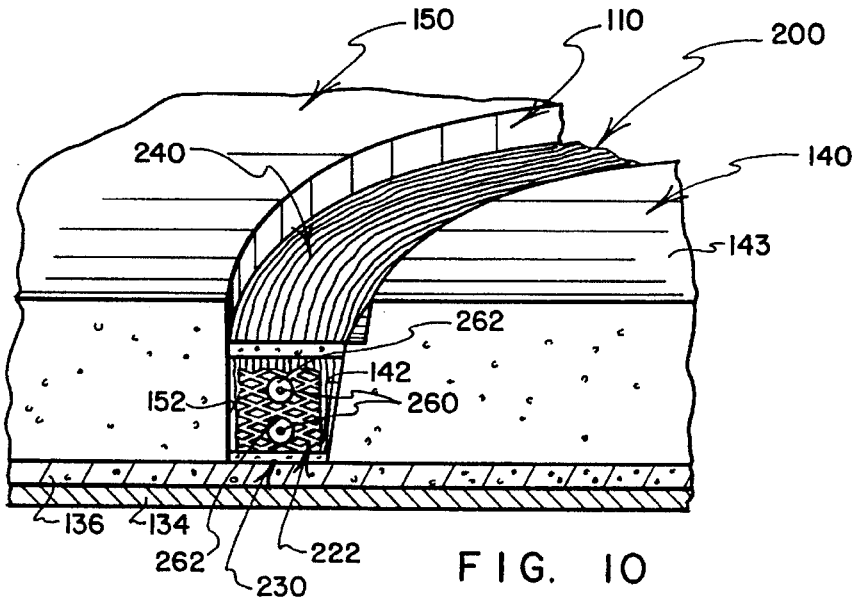
FIG. 10 is a perspective view similar to FIG. 9 but with the fiber seal components of FIG. 8 installed in the inner seal trough to form an inner seal.

Referring to FIGS. 1, 9, 10 and 22, a blanket of refractory fiber material, indicated by the numeral 136, preferably is installed atop the steel plate 134 to underlie the cast refractory inner and outer base structures 140, 150, and to underlie the inner seal troughs 110. While the blanket 136 is depicted in FIGS. 9 and 10 as having a thickness of typically about an inch, it will be understood that the blanket 136 tends to flatten under the heavy weight of the cast refractory inner and outer structures 140, 150, and under the heavy weight of the inner enclosures 102 seated atop the inner seals 200.

Referring to FIG. 1, each of the inner seal troughs 110 (within which one of the inner seals 200 is positioned) constitutes an annular, upwardly opening space that is defined atop the plate 134 and between an associated set of the segments 144, 154, 155 that form the cast refractory inner and outer base structures 140, 150. A circumferentially extending, radially outwardly facing surface 142 of the inner base structure 140, and an opposed, radially inwardly facing surface 152 of the outer base structure 150 define opposite sides of each of the inner seal positioning troughs 110.

The opposed surfaces 142, 152 are arranged in pairs, with each pair extending substantially concentrically about a separate one of the inner base structures 140. The surfaces 142, 152 of each of the pairs cooperate to define a cross-section of an associated inner seal trough 110 that remains substantially constant along its entire circumferentially extending length—a cross-section preferably is uniform among the troughs 110, and that preferably has a width that narrows with trough depth.

The diminishment of the width of the inner seal positioning trough 110 with trough depth can be achieved by inclining either or both of the surfaces 142, 152 that define opposite sides of the trough 110. Inclination of the inner surface 142 is the approach taken in the furnace base embodiments 130 and 130B, as illustrated in FIGS. 1 and 2, respectively, where the inner surfaces of the inner seal troughs 110 that are depicted as being inclined with respect to the vertical—preferably to diminish the widths of the inner seal troughs 110 by about one inch per six inches of trough depth—whereas the outer surfaces 152 of the troughs 110, as depicted in FIGS. 1 and 2, extend substantially vertically. Outer surface inclination, however, is the approach taken in the furnace base embodiment 130A of FIG. 13, which employs an outer surface 152A of an inner seal trough 110A of a cast refractory outer structure 150A that is inclined with respect to the vertical—again with about a 1:6 ratio that diminishes trough width about one inch per six inches of trough depth—whereas the inner surface 142A of the inner seal trough 110A is depicted as extending substantially vertically.

A variety of outer seal embodiments can be used in annealing furnace bases that employ the fiber type inner seals that correspond to the preferred practice of the present invention (features of the fiber inner seal system of the present invention will be described later herein in conjunction with FIGS. 5–10). While the furnace base embodiments 130 of FIGS. 1 and 13, respectively, employ substantially identical sand-type outer seals 300 that utilize sand carried in outer seal troughs 120 that are bordered by structural steel 160 that is welded to an underlying plate 134, the furnace base embodiment 130B of FIG. 2 has an inner surface 156B of its outer seal trough 120B defined and lined by hard, wear and impact resistant ceramic inserts 750 (the character of which will be described in greater detail later herein) that are anchored to the outer base segment 154B, 155B when the outer segments 154B, 155B are mold-formed (the basic nature of the procedure utilized to mold-form inner and outer base segments will be described later herein in conjunction with a discussion of FIGS. 14 and 15); and, the same fiber seal modules 250 together with lower and upper blankets 230, 240 of refractory fiber (these components are described in greater detail later herein in conjunction with FIGS. 5–10) that are utilized in accordance with preferred practice to form inner seals 200 of annealing furnaces are positioned in the outer seal trough 120B to be sealingly engaged by a flat bottom surface 116B of the outer furnace enclosure 112B.

As those who are familiar with annealing furnace operation will readily understand, it is the function of the inner seal 200 to cooperate with the depending rim 108 of the inner enclosure 110 to maintain a closed environment treatment chamber 170, within which a charge of metal 190 can be supported for being subjected to an annealing process wherein a positive pressure, non-oxidizing atmosphere typically is maintained within the treatment chamber 170 (i.e., within the inner enclosure 110) while a furnace chamber 180 (defined within the outer enclosure 120) is heated by conventional furnace structure (not shown) to bring the treatment chamber 170 to a desired elevated temperature, whereafter controlled cooling of the charge of metal 190 is permitted to take place in the treatment chamber 170 to bring the charge of metal 190 back to near ambient temperature.

As is depicted in FIG. 1, the charge of metal 190 that typically is treated in the furnace 100 includes a plurality of coils 191, 192, 193 of steel, with convector plates 60 being inserted between adjacent pairs of the coils to space the coils apart and to provide for circulation of gas therebetween. A desirable type of convector plate 60 to use for such a purpose is described in Coble U.S. Pat. No. 5,048,802. To support the charge of metal 190 atop the cast refractory components of the base 130 (and the same is true with respect to the base 130A of FIG. 13), an assembly of metal base components, that form what is referred to as a "diffuser base," indicated generally by the numeral 50, is positioned atop the cast refractory inner structure 140. Desirable types of diffuser base components 50, and the preferred manner in which these components are utilized, are described in detail in the above-identified Annealing Furnace Patents of Gary L. Coble.

A fan 70 having a rotary impeller 72 is disposed substantially centrally among the metal base components 50 for circulating non-oxidizing gases within the closed environment of the treatment chamber 170. During an annealing operation, the fan 70 is operated to circulate an inert gas within the treatment chamber 170 among the coils of steel 191, 192, 193 while a furnace heating system (typically carried by the outer enclosure 112, but not shown in the drawings inasmuch as the nature of heating systems used by annealing furnaces are quite well known and forms no part of the present invention) heats the furnace chamber 180 so that the inner enclosure 102 is heated which, in turn, causes the gases within the treatment chamber 170 to be heated. The temperature of the gases that are circulated within the treatment chamber 170 typically is elevated to as high as 1500 degrees Fahrenheit (sometimes higher) for a period of time sufficient to heat and treat the steel that forms the coils 191, 192, 193, and then is slowly lowered to ambient temperature to complete the annealing process, whereafter the enclosures 102, 112 are raised to permit the coils 191, 192, 193 to be removed, and to the process to be repeated with a new charge of metal.

Each of the cast refractory segments 144, 154, 155 is "cast" (i.e., each is individually formed in a separate mold—which molds must be quite large in size inasmuch as the segments 144, 154, 155 that are to be formed also are quite large in size), utilizing a castable refractory material that, when set and cured, will provide segments 144, 154, 155 that will withstand some reasonable amount of being bumped about while being transported to and installed at a furnace site.

While improvements in, and new forms of castable refractory materials are constantly being made, the preferred type of castable refractory material that presently is utilized to mold-form the segments 144, 154, 155 to provide rigid ceramic structures that will withstand use in a steel production facility where temperatures are repeatedly cycled between ambient temperature and temperatures of about 1500 degrees Fahrenheit (and higher) are low cement containing mixtures that include about 45 to about 47 percent alumina ($Al_2O_3$), about 45 to 47 percent silica ($SiO_2$), and that contain about 2 percent, by weight, of thin stainless steel needles (that typically are about an inch in length and are included to provide strength and reinforcement to the resulting product)—which are mixed with a sufficiently small quantity of water to barely bring the material to a dry granular consistency that can be fed into a mold without causing a cloud of dust to arise as the mix is fed into the mold, and which require the presence of power-induced mold vibration in order to ensure that the material is properly distributed throughout the mold to form a mixture of even consistency that can be cured to form a strong, temperature-cycle-resistant product.

While castable refractory materials of the type just described are commercially available from a variety of sources, a presently preferred castable refractory is sold by Premier Refractories and Chemicals, Inc. of King of Prussia, Pa. 19406 under the product designation "Criterion 45," which is described as being an alumina and silicate based, general-duty, low cement containing, vibration castable that needs to be mixed with relatively little water, and that can provide cast products of relatively high density, relatively low porosity, and relatively high strengths—as compared with products produced from other forms of present-day-available cast refractory materials. Cast refractory products formed with this material are understood to perform in environments that are cycled repeated between ambient temperature and elevated temperatures as high as about 2800 degrees Fahrenheit.

Figure 14:
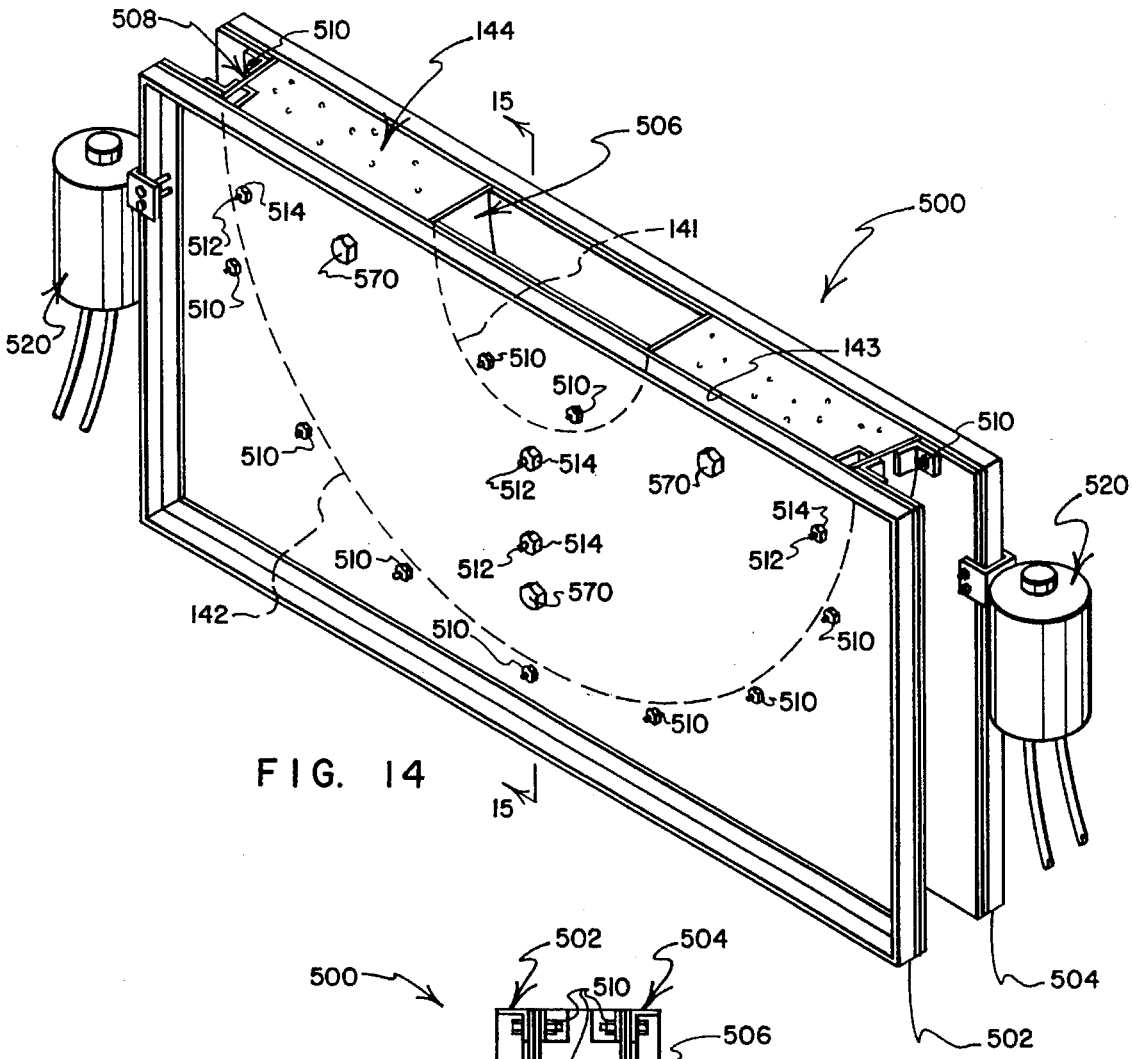
FIG. 14 is a perspective view of a disassemblable mold of the general type that preferably is utilized to mold-form castable refractory material to cast the inner and outer cast refractory segments that are employed in annealing furnace bases that embody the preferred practice of the present invention, with a pair of power operated mold vibrators clamped to the mold for vibrating the mold during the introduction into and distribution within the mold of castable refractory material.
Figure 15:
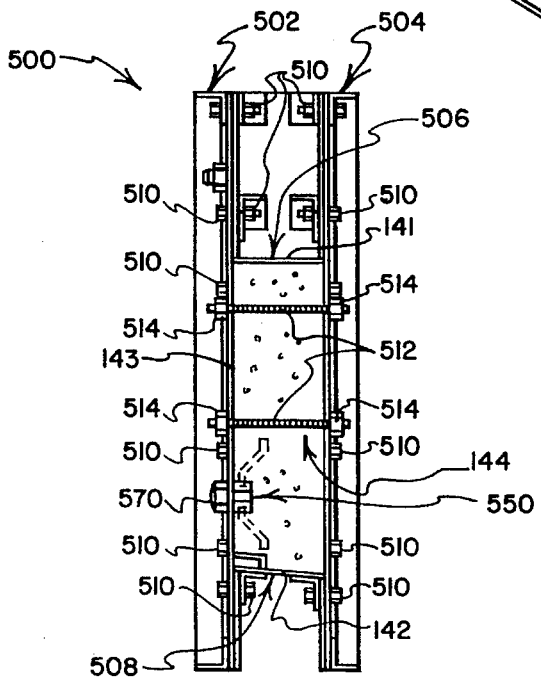
FIG. 15 is a sectional view as seen from a plane indicated by a line 15—15 in FIG. 14.

Referring to FIGS. 14 and 15, a typical form of disassemblable steel mold that preferably is utilized to form one of the C-shaped inner segments 144 is indicated by the numeral 500. The mold 500 has a pair of opposed front and rear side structures 502, 504 that preferably are formed as welded assemblies from structural steel forms such as angle iron, and steel plate stock. Curved inner and outer surfaces 141, 142 of a C-shaped segment 144 are formed by appropriately curved steel plates 506, 508 that are installed between the front and rear structures 502, 504. Bolts 510 extending through appropriately positioned bolt holes are utilized to connect the front and rear structures 502, 504 to the curved plates walls 506, 508—and are removable to permit the mold 500 to be disassembled when a newly molded segment 144 is to be removed therefrom.

Also serving to tie the front and rear structures together are four threaded rods 512 that extend through aligned holes formed in the front and rear structures 502, 504, and through the segment-defining cavity of the mold 500, with opposite ends of the rods 512 being connected to the structures 502, 504 by nuts 514.

Referring to FIG. 14, in order to powerfully vibrate the mold 500 during the feeding into and during distribution within the mold 500 of castable refractory material, a pair of commercially available mold vibrator units 520 (typically pneumatically operated) are shown clamped to opposite corner regions of the mold 500. The vibrator units 520 are widely available, and are commonly employed when "vibration casting" is called for, as will be readily understood by those who are skilled in the art.

The front structure 502 of the mold 500 forms a "top" surface 143 of a C-shaped inner segment 144 that is being formed in the mold 500—meaning that, when the inner segment 144 is positioned for use in the furnace 100, the surface 143 will face upwardly. To facilitate the connecting of a crane to the segment 144 for use in moving the segment from place to place (and in final positioning the segment 144 at a furnace site), three identical lift connectors 550 are embedded within the segment 144 during molding of the segment 144, one of which is depicted in the sectional view of FIG. 15, but is best seen in the sectional view of FIG. 18.

Figure 17:
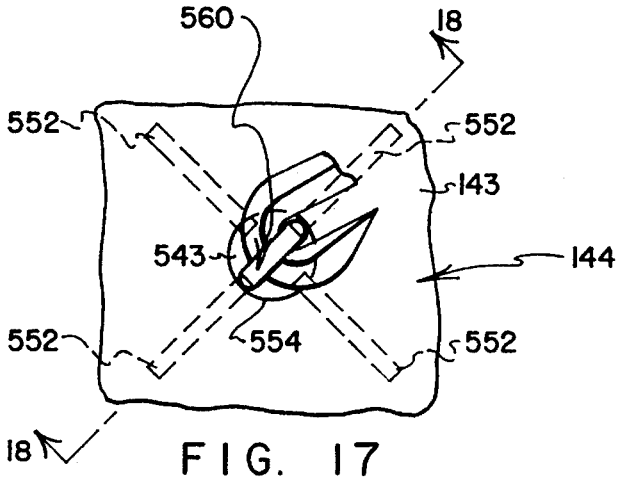
FIG. 17 is a top plan view on an enlarged scale of a portion of the segment of FIG. 16, as seen from a plane indicated by a line 17—17 in FIG. 16, with hidden lines depicting the deployment of anchor portions of a typical one of three lift connections that extend into the cast refractory material of the segment.
Figure 18:
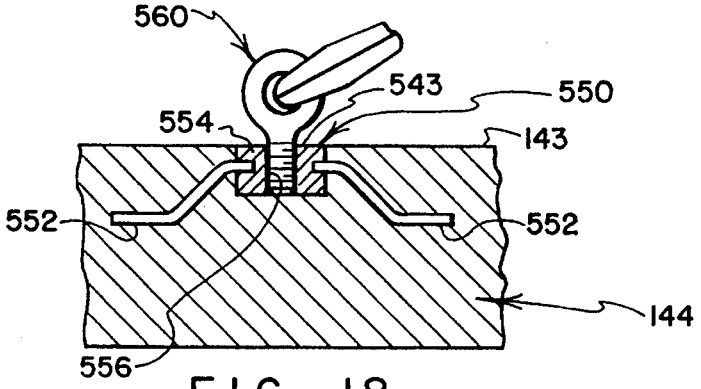
FIG. 18 is a sectional view as seen from a plane indicated by a line 18—18 in FIG. 17.

Referring to FIGS. 17 and 18, the lift connector 550 includes four dog-legged anchor formations 552 that extend into the cast refractory material of the segment 144 from a centrally located hub 554 that has a threaded passage 556 extending therethrough. An outer surface 543 of the hub 554 is positioned to extend flush with the front surface 143 of the segment 144—and the threaded passage 556 opens through the outer surface 543 so that an eyebolt 560 can be removably treaded into the passage 556.

Figure 16:
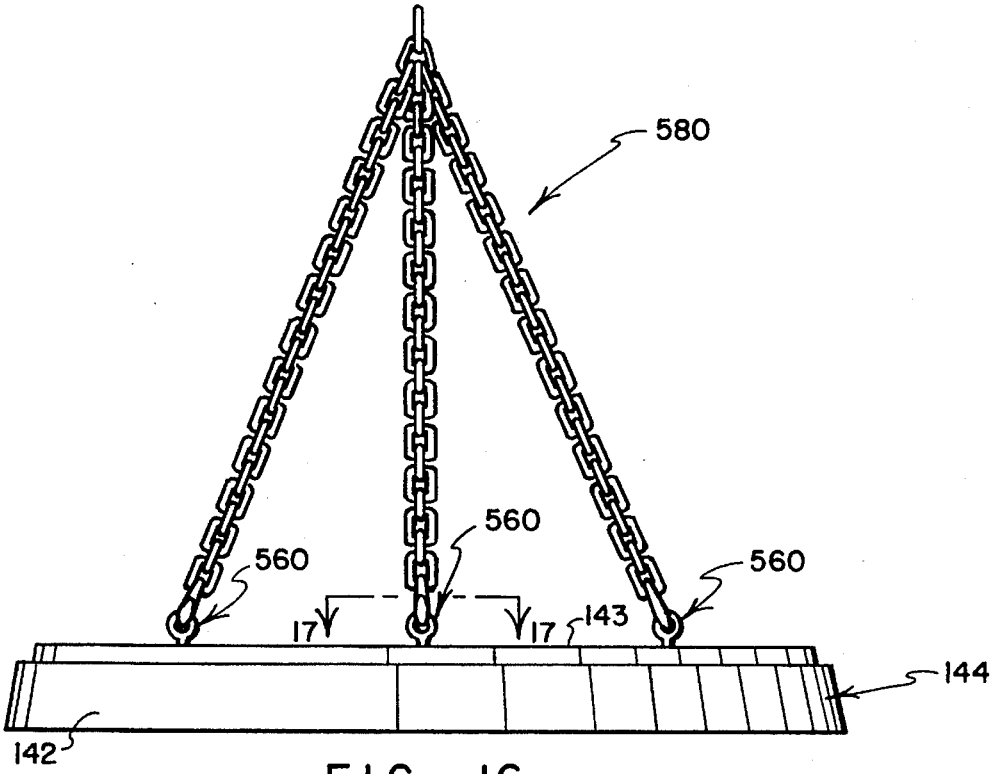
FIG. 16 is a side elevational view depicting a crane-connected, triumvirate type lifting fixture supporting a typical one of the cast refractory segments in a horizontally extending attitude, as during segment positioning and installation.

Three of the lift connectors 550 are incorporated into each of the cast refractory segments 144, 154, 155 at spaced locations—as is indicated in FIG. 3 by the numerals 550. A triumvirate type sling 580, as depicted in FIG. 16, can be connected to three eyebolts 560 that are threaded into the three lift connectors 550 of each of the segments 144, 154, 155 to move the segments 144, 154, 155 one at a time from place to place, and to final-position the segments 144, 154, 155 at a furnace site, while holding each of the segments 144, 154, 155 in a horizontal attitude. By this arrangement, there is no need to wrap chains or cables about the segments 144, 154, 155 to lift and move the segments 144, 154, 155; nor is there a need to try to balance the segments 144, 154, 155 on the forks of a lift truck or the like—which can cause unwanted chipping, cracking and other forms of segment damage and deterioration.

Referring to FIGS. 14 and 15, to hold the lift connectors 550 in place within the mold 500 during casting of the segment 144, three bolts 570 are threaded through holes formed in the front structure 502 and into the threaded passages 556 of three of the lift connectors 550. Once the molding of the segment 144 has been completed, the bolts 570 are removed so that the newly cast segment 144 does not remain securely bolted to the front structure 502. And, in the same general manner that has just been described, others of the segments 144, 154, 155 are mold-formed from castable refractory material, and are provided with anchored-in-place lift connectors 550.

The cast refractory outer segments 154B, 155B of the furnace base embodiment 130B that is depicted in FIGS. 2 and 4 have an added complication that needs to be taken into account when they are molded. As is best seen in FIG. 2, the hard, wear and impact resistant, pre-cast ceramic inserts 750 that are provided to extend along outer peripheral surfaces of the outer segments 154B, 155B have wire-like anchor formations 751 that project into the cast refractory material of the segments 154, 155—in much the same manner that the doglegged anchor formations 552 of the lift connectors 550 extend into the cast refractory material of the inner segments 144. To form the outer segments, the pre-case inserts 750 must be positioned by appropriately configured molds (not shown) to extend along peripheral segment surfaces that will be formed by the molds, with the anchor formations 751 positioned to project into the cavities of the molds so as to be surrounded by and embedded within the castable refractory material as the segments 154B, 155B are molded.

An advantage that derives from securely anchoring the hard, wear and impact resistant, pre-cast inserts 750 to the segments 154B, 155B to define at least selected portions of the surface that lines the inner side of the outer seal trough 120B is that the inserts 750 will enable the segments 154B, 155B to withstand the kinds of contact and impact that normally can occur when the outer enclosure of an annealing furnace tis raised and lowered—hence there is no need to line the inner surface of the outer seal trough with structural steel, nor to put up with the problems that are encountered with warpage and weld breakage as such structural steel is detrimentally affected by being subjected to repeated cycles of operation of an annealing furnace.

While inserts 750 are depicted in FIG. 4 as being provided on all of the outer segments 154B, 155B to line the entire inner surface of the outer seal trough 120B, it will be understood that only selected ones of the segments 154B and/or 155B, or selected portions of the segments 154B and/or 155B can be provided with the hard, wear and impact resistant, pre-cast ceramic inserts 750, if desired; and that other segment surfaces can, if desired, likewise incorporate such inserts.

While hard, wear and impact resist inserts 750 can be formed from a wide variety of commercially available refractory materials, one commercially available refractory material that has been found to be particularly well suited for this purpose is a so-called "slurry infiltrated fiber castable" (known by the acronym "SIFCA") that utilizes a refractory castable slurry to infiltrate a high volume of stainless steel fiber (it can contain up to 16 percent by volume of stainless steel fiber) to form a hard, wear and impact resistant mold-formed article that will function well in environments that cycle through temperature ranges that extend from ambient temperature through temperatures well in excess of 2000 degrees Fahrenheit. The slurry composition that is used is a low cement castable comprised of about 65 percent $AL_2O_3$, a more complete description of which is provided in U.S. Pat. No. 4,366,255 issued Dec. 28, 1982, the disclosure of which is incorporated herein by reference.

Referring to FIGS. 8–10, the inner seal 200 preferably is formed as a serial array of generally cube shaped fiber refractory blocks 210, 212, interspersed among which are a plurality of thin pieces of perforated metal 220, 222 (preferably stainless steel), with the array of fiber blocks 210, 212 and metal members 220, 222 being underlaid by a narrow, elongate blanket 230 of fiber refractory material that is installed in bottom portions of the inner seal trough 110, and being overlaid by a narrow, elongate blanket 240 of fiber refractory material that is installed in upper portions of the inner seal trough 110.

Referring to FIG. 5, the blocks 210, 212 of fiber refractory material preferably are cut from an elongate log or bar 214 of fiber refractory material that is preferably is selected to have a width that will extend the full distance between the inner and outer surfaces 142, 152 at the widest dimension of the trough 110 that is to be occupied by the fiber blocks 210, 212, and a height that preferably is approximately equal to the width.

In preferred practice, the upper portion of the inner seal trough 110 that is to be occupied by the blocks 210, 212 measures six inches in width; the log or bar 214 of fiber refractory material from which the blocks 210, 212 are cut has width and height dimensions of six inches; a plurality of identical blocks 210, 212 measuring six inches by six inches by six inches are cut from the log or bar 214; and the bottom region of the trough 110 into which the blocks 210, 212 are to extend has a width of about five inches—so that, as the blocks 210, 212 are pressed down into the trough 110, bottom regions of the blocks 210, 212 are wedged and compressed a bit to ensure a snug fit in the trough 110.

Because the log or bar 214 of fiber refractory material from which the fiber blocks 210, 212 are cut typically is formed from elongate fibers of refractory material that are blow-formed to fabricate the log 214 in such a way that it tends to have fluffy "layers" of fiber (indicated generally by the numeral 216 in FIGS. 5–9) with a very perceptible direction of fiber orientation (indicated generally by arrows 218, 219 in FIGS. 5 and 6), care needs to be taken in selecting the manner in which the fiber blocks 210, 212 are oriented for insertion into the trough 110. After the blocks 210, 212 are cut from the log or bar 214, each of the blocks 210, 212 preferably is re-oriented by turning it in a right-angle manner that is indicated by an arrow 219 in FIGS. 5 and 6 before the re-oriented blocks 210, 212 are positioned side by side in the manner that is indicated in FIG. 6 to form the array that ultimately is inserted into the inner seal trough 110 to form the heart of the inner seal 200. By this arrangement, when the array of fiber blocks 210, 212 and metal members 220, 222 is installed in the trough 110, the "planes" 216 of fibers of the blocks 210, 212 will extend generally radially relative to the inner structure 140, not circumferentially with respect to the trough 110.

Referring to FIGS. 6 and 7, in preferred practice, approximately six adjacent ones of the re-oriented fiber blocks 210 are selected to form a fiber seal module 250 that can be put in place in the trough 110 as a unit. An assembled module 250 is depicted in FIG. 7. Portions of components included in the module 250 are depicted in FIG. 6. As will be apparent from comparing the fiber blocks 210 as they are depicted in FIGS. 6 and 7, when the module 250 is assembled, the fiber blocks 210 preferably are compressed to tightly sandwich such thin expanded metal members 220 as are interspersed among the fiber blocks 210 of the module.

In this document, the word "interspersed" is utilized in a normal way to designate placement of the metal members 220, 222 "at intervals in and/or among" the fiber blocks 210—which includes the preferred way of arranging the metal members 220, 222, namely between adjacent ones of the blocks 210, and also allows for the possibility that metal members 220 also could be inserted among the layers of fibers 216 within the blocks 210, 212. In preferred practice, seven thin metal members 220, 222 are utilized together with six fiber blocks 210 to form a module 250, with five of the metal members 220 each being sandwiched between separate adjacent pairs of the six fiber blocks 210, and with the remaining two metal members 222 serving end caps for the module 250.

To hold the module 250 together, two thin stainless steel rods 260 preferably are inserted through the six fiber blocks 210 and through the seven metal members 220, 222; washers 262 are installed on opposite ends of the rods 260; and ends of the rods 260 are welded to the washers 262 at locations that will hold the fiber blocks 210 and metal members 220, 222 of the module 250 in a suitably compressed form. Suitable module compression preferably is achieved by causing the end cap metal members 222 to be pressed toward each other to the extent that is needed to uniformly compress each of the fiber blocks 210 of the module to about two thirds of its normal length. In preferred practice, if each of the fiber blocks 210 measures six by six by six inches in size, compression of the blocks 210 during formation of a module 250 serves to reduce each of the blocks 210 to about six by six by four inches, with the resulting six-block module 250 having an overall length of about twenty four inches.

In preferred practice, a plurality of modules 250 of the type just described are utilized in forming the inner seal 200. Between each assembled module 250, a single fiber block 212 preferably is installed as a "spacer;" and, each of these "spacer" blocks 212 preferably is compressed to about two thirds of its normal length during the installation of the modules 250 and spacer blocks 212. If, when the installation of an inner seal 200 is about to be completed, it is found that room does not remain within the inner seal trough 110 to insert yet another full module 250 (but too much room remains in the trough 110 to be filled by only one of the compressed spacer blocks 212), more than one of the spacer blocks 212 can be installed in compressed form between selected adjacent pairs of the modules 250—so that not more than two or three of the compressed spacer blocks 212 will need to be installed between any of the adjacent pairs of modules 250.

Because the modules 250 tend to be straight (linear in nature) when formed, but need to be installed in an inner seal trough 110 that is curved, each of the modules 250 can be slightly bent, as is depicted in FIG. 8, prior to being installed. The thin diameter of the stainless steel rods 260 that extend through each of the modules 250 permits this, and the positioning of the two rods 260 of each module 250 one atop the other ensures that the presence of the rods 260 does not severely hinder efforts to deflect the shape of the modules 250 to conform to the curvature of the inner seal trough 110.

Figure 11:
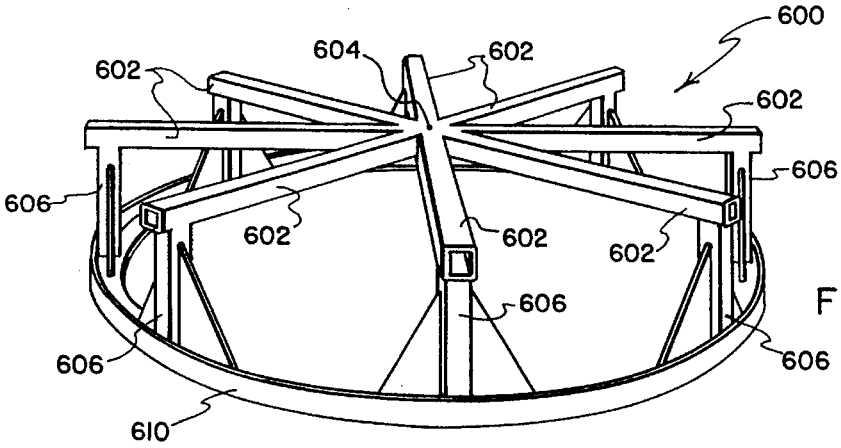
FIG. 11 is a perspective view of a special tool that, in accordance with preferred practice, is utilized in the assembly, maintenance, repair and rebuilding of trough-installed fiber seals that embody features of the present invention.
Figure 12:
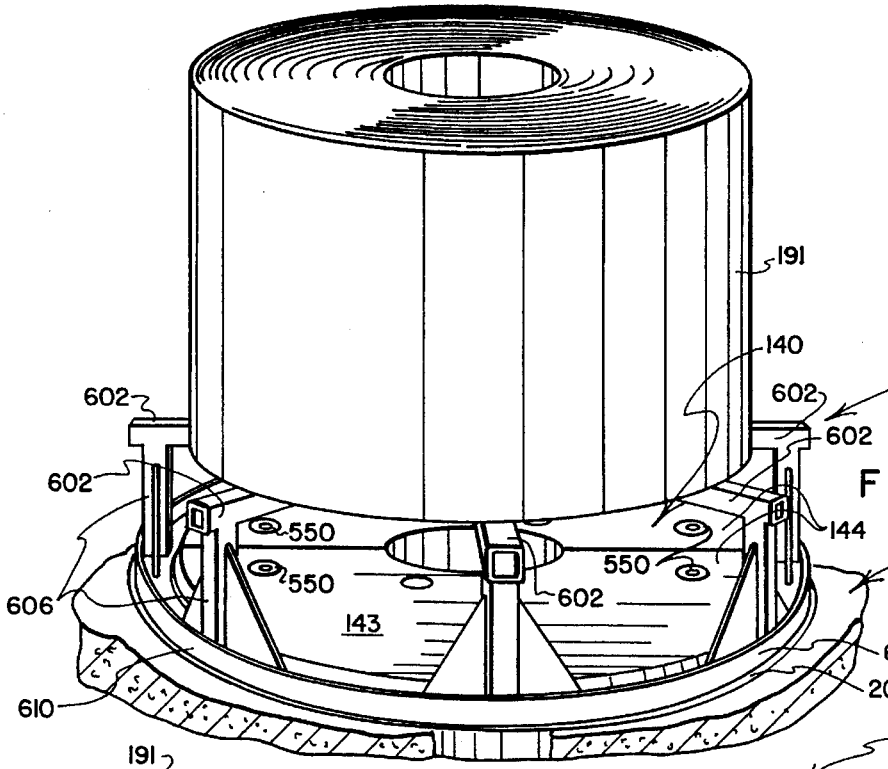
FIG. 12 is a perspective view showing the tool of FIG. 11 seated in engagement with a trough-carried inner seal, and having a heavy object, namely a coil of steel, resting atop the tool to provided needed weight.

While the modules 250 and spacer blocks 212 normally can be installed one at a time in the inner seal trough 110, by hand, with good success, pressing the modules 250, spacer blocks 212 and blankets 230, 240 into position to final-form an inner seal 200 preferably is carried out with the aid of a special tool 600 that is depicted in FIG. 11. Referring to FIG. 11, the tool 600 is a "compression fixture" that has a set of spoke-like bars 602 that connect at the center 604 of the tool 600, and that support depending uprights 606 that connect with a compression ring 610. The compression ring 610 has a flat bottom surface that is slightly more narrow than the width of the inner seal trough 110. The compression ring 610 is sized to be positionable atop a newly installed inner seal 200, as is illustrated in FIGS. 12 and 13, and is sufficiently strong to permit a heavy object, such as a coil of steel 191, to be seated atop the spoke-like bars 602 so that the weight of the coil 191 can be transferred to the compression ring 610 for pressing downwardly against the inner seal 200 to flatten and shape the top surface of the inner seal 200, and to ensure that all components of the inner seal 200 are seated and positioned within the inner seal trough 110.

The compression tool or fixture 600 also preferably is utilized periodically between operational cycles of the furnace 100 to again press and shape the inner seal 200—which tends to have something of a rejuvenation effect to restore life to and maintain the life of the inner seal 200. Likewise, if one or more components of the inner seal 200 (for example the upper blanket 240) has been repositioned or replaced, the compression fixture 600 preferably is utilized to press and reform the seal 200 before the seal 200 is again put into service.

The refractory fiber insulation that is used to form the underlying blankets 136, 230, the overlying blanket 240, and the fiber blocks 210, 212 should comprise a man-made refractory ceramic fiber product that is characterized by substantially uniform consistency, by a melting point of no less than about 3200 degrees Fahrenheit, and that is capable of rendering lengthy service without encountering significant deterioration while being cycled through a range of temperatures ranging from ambient temperature to about 1500 degrees Fahrenheit (and while being maintained at relatively high temperatures such as 1500 degrees Fahrenheit). Such products are available commercially from a variety of sources, for example from Thermal Ceramics, Inc. of Augusta, Ga. 30903 sold under trademarks KAOWOOL and PYRO-LOG R, or from Carborundum Company, Fibers Division, Niagara Falls, N.Y. 14302 under the trademark DURA-BLANKET S. Such materials are available in blanket form and in log form, as needed to form the blanket-like members 136, 230 and 240 and the fiber blocks 210, 212, respectively.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. While orientation terms as "upwardly," "downwardly," "leftwardly," "rightwardly" and the like have been utilized in describing the invention, these terms should not be interpreted as being limiting. It is intended that the patent shall cover, by suitable expression in the appended claims, whatever features of patentable novelty exist in the invention disclosed.

What is claimed is:

1. A method of assembling from a set of component parts, at a location atop a base support structure of a plural-stack annealing furnace, 1) a rigid ceramic refractory base for extending in substantially concentric, annular relationship about a plurality of spaced blower mounts of the furnace, for underlying and extending perimetrically about a plurality of charge support structures of the furnace that are of generally circular shape and that are configured to overlie the blower mounts to support a plurality of charges of metal that are to be annealed, and 2) a plurality of relatively resilient annular inner seals that extend perimetrically about the charge support structures, atop which inner enclosures of the furnace can be removably supported for defining a plurality of controlled environment treatment chambers within which charges of metal that are positioned atop the charge support structures can be confined for treatment during an annealing process, comprising the steps of:

a) providing inner segment means including a plurality of sets of cast refractory inner segments, and installing each set of the inner segment means 1) to define a separate associated annular-shaped inner portion of the rigid ceramic refractory base for extending substantially concentrically about a separate associated one of a plurality of blower mounts of a plural-stack annealing furnace, 2) to underlie and support a separate associated one of a plurality of generally circular charge support structures of the furnace, and 3) to define a separate associated one of a plurality of substantially continuous, radially outwardly facing surfaces that each extends substantially concentrically about a separate associated one of the circular charge support structures at a location near the periphery thereof;

b) providing outer segment means including a set of cast ceramic refractory outer segments, and installing the outer segment means so that the outer segments extend side by side to cooperatively define a generally rectangular outer region of the rigid ceramic refractory base atop which a generally rectangular outer enclosure of the furnace can be removably seated, with smaller groups of the outer segments of the set comprising outer segment sub-sets, with the segments of each sub-set extending about an associated separate one of said annular-shaped inner portions to define arcuate portions of a separate associated, radially inwardly facing surface that extends concentrically about a separate associated one of said radially outwardly facing surfaces so as to cooperate therewith to define opposite, radially spaced sides of an associated inner seal positioning trough for extending circumferentially about a separate associated one of the circular charge support structures of the furnace;

c) providing inner Seal means including a plurality of separate inner seals, and installing each of the inner seals atop the base support structure of the furnace and in a separate one of said troughs, with the installed inner seals 1) each extending in an endless, substantially uninterrupted, ring-like manner about the periphery of a separate associated one of the circular charge support structures, 2) each being capable of supporting the weight of a separate associated open-bottom, tank-like inner enclosure of the furnace when bottom rim portions of the associated inner enclosure are seated thereatop, and 3) each being sufficiently resilient to cooperate with the seated bottom rim portions of the associated inner enclosure to form a gas impervious seal for isolating the environment of an associated treatment chamber;

d) with the foregoing steps being carried out such that the installed inner seals each include a separate set of ceramic fiber blocks arranged serially in a circumferentially extending, endless, ring-like array within the confines of an associated one of said troughs, with each of said arrays also including a plurality of relatively thin, perforated metal members interspersed among the ceramic fiber blocks of the array to extend substantially radially at circumferentially spaced intervals within the confines of the associated trough, with said blocks having radially extending widths that are sufficient to extend substantially the full radially-measured distance between said radially outwardly facing surface and said radially outwardly facing surface of the associated trough at such locations therein as are to be occupied by said blocks, and with the blocks that are included in each array being sufficient in number and in size to require that said blocks be compressed in directions extending circumferentially with respect to the associated trough in order for all of said blocks to be inserted serially into the associated trough to form said array.

2. The method of claim 1 wherein the steps of providing and installing inner segment means include the steps of providing and installing a plurality of arcuate-shaped inner segments that are of substantially identical configuration and are therefore interchangeable one with another.

3. The method of claim 1 wherein the steps of providing and installing inner segment means include the steps of providing and installing pairs of substantially identically configured, half-circle shaped inner segments.

4. The method of claim 1 wherein the steps of providing and installing inner segment means include the steps of providing and installing inner segments that define at least one of the associated radially outwardly facing surfaces such that it is of a truncated conical form that is inclined with respect to the associated radially inwardly facing surface so as to narrow the width of bottom portions of the associated inner seal positioning trough so that, as the associated inner seal is compressed within the associated trough by the seating thereatop of the associated inner enclosure of the furnace, the associated inner seal will continue to extend substantially the full radially measured distance between the associated pair of radially outwardly facing and radially inwardly facing surfaces at such locations within the associated trough as are occupied by the associated inner seal.

5. The method of claim 1 wherein the steps of providing and installing said inner segment means and said outer segment means include the steps of configuring and installing said inner segment means and said outer segment means such that at least one of an associated pair of radially inwardly facing and radially outwardly facing surfaces is of a truncated conical form that serves to narrow the width of bottom portions of the associated inner seal positioning trough so that, as the associated inner seal means is compressed within the associated trough by the seating of the associated inner enclosure of the furnace thereatop, the associated inner seal will continue to extend substantially the full radially measured distance between said associated pair of surfaces at such locations within the associated trough as are occupied by the associated inner seal.

6. The method of claim 1 wherein the steps of providing and installing said inner segment means and said outer segment means include the steps of configuring and installing said inner segment means and said outer segment means such that all of the inner seal positioning troughs maintain a substantially uniform cross-sectional configuration as they extends circumferentially about the charge support structures of the furnace, with said uniform cross-sectional configuration being tapered such that the inner seal positioning troughs narrow toward bottom regions thereof.

7. The method of claim 1 wherein the steps of providing and installing the inner seal means include the steps of providing a separate relatively thin lower blanket of ceramic fiber refractory material for each of said troughs, and installing the lower blankets in said troughs to underlie said arrays of ceramic fiber blocks and perforated metal members.

8. The method of claim 1 wherein the steps of providing and installing the inner seal means include the steps of providing a separate relatively thin upper blanket of ceramic fiber refractory material for each of said troughs, and installing the upper blankets in said troughs to overlie said arrays of ceramic fiber blocks and perforated metal members.

9. The method of claim 1 wherein the steps of providing and installing outer segment means include the steps of providing and installing four individual outer segments per outer segment sub-set to define an associated one of the radially inwardly facing surfaces, with at least a designated pair of the individual outer segments of a selected one of the sub-sets 1) being of substantially identical configuration, and 2) being shared with another of the sub-sets in the sense that each of the segments of said designated pair also defines portions of another of said radially inwardly facing surfaces.

10. The method of claim 9 wherein the step of providing and installing the outer segment means include the steps of providing and installing four individual outer segments per sub-set 1) in such a manner that each of the four individual segments defines at least the majority of a quarter circle portion of said one of the associated radially inwardly facing surfaces, and 2) in such a manner that each of the segments of said designated pair also defines at least the majority of a quarter circle portion of said another of the radially inwardly facing surfaces.

11. The method of claim 9 wherein the steps of providing and installing the outer segment means are carried out in such a way that each of the segments of said designated pair has a linear extending outer portion that is installed to define a side part of said generally rectangular outer region of the rigid ceramic refractory base atop which the outer enclosure of the furnace can be removably seated.

12. The method of claim 11 wherein the steps of providing and installing the outer segment means are carried out in such a way that at least a selected outer surface area of at least one of said side parts which may be engaged by the outer enclosure of the furnace during seating and unseating movement of the outer enclosure is reinforced by having its selected outer surface area formed from a cast refractory material that contains a sufficient volume of elongate, stainless steel, needle shaped members to provide said selected outer surface area with enhanced strength and wear resistance.

13. The method of claim 12 wherein the steps of providing and installing the outer segment means are carried out in such a way that the cast refractory material that is utilized to reinforce said selected outer surface area is formed as a pre-cast member that has steel anchor formation means extending therefrom for anchoring the pre-cast member to the cast refractory material from which adjacent other portions of said at least one side part is formed.

14. The method of claim 9 wherein the steps of providing and installing the outer segment means are carried out in such a way that two of the four individual outer segments of at least one of the outer segment subsets each defines a right-angle shaped outer portion that provides a corner part of said generally rectangular outer region of the rigid ceramic refractory base atop which the outer enclosure of the furnace can be removably seated.

15. The method of claim 14 wherein the steps of providing and installing the outer segment means are carried out in such a way that at least a selected outer surface area of at least one of said corner parts which may be engaged by the outer enclosure of the furnace during seating and unseating movement of the outer enclosure is reinforced by having its selected outer surface area formed from a cast refractory material that contains a sufficient volume of elongate, stainless steel, needle shaped members to provide said selected outer surface area with enhanced strength and wear resistance.

16. The method of claim 15 wherein the steps of providing and installing the outer segment means are carried out in such a way that the cast refractory material that is utilized to reinforce said selected outer surface area is formed as a pre-cast member that has steel anchor formation means extending therefrom for anchoring the pre-cast member to the cast refractory material from which adjacent other portions of said at least one corner part is formed.

17. The method of claim 1 wherein the steps of providing and installing the outer segment means are carried out such that the set of outer segments, when arranged side by side to cooperatively define said generally rectangular outer region, additionally define a substantially continuous, perimetrically extending, outwardly facing surface adjacent which an outer seal of the furnace can extend for being engaged by the outer enclosure of the furnace when the outer enclosure is stated atop said outer region.

18. The method of claim 17 wherein the steps of providing and installing the outer segment means are carried out such that at least a portion of said perimetrically extending, outwardly facing surface is reinforced by forming said portion from a cast refractory material that contains a sufficient volume of elongate, stainless steel, needle shaped members to provide said portion with enhanced strength and wear resistance.

19. The method of claim 18 wherein the steps of providing and installing the outer segment means are carried out in such a way that the cast refractory material that is utilized to reinforce said outwardly facing surface is formed as a pre-cast member that has steel anchor formation means extending therefrom for anchoring the pre-cast member to the cast refractory material from which adjacent other portions of said outer segment means is formed.

20. The method of claim 1 wherein the steps of providing and installing the outer segment means are carried out such that said sub-sets of outer segments define adjacent pairs of said radially inwardly facing surfaces that intersect substantially tangentially as to cause the associated pair of inner seal positioning troughs to form a substantially tangential juncture that extends along said troughs for only short segments of the circumferentially extending lengths of said troughs, and the method additionally includes the steps of providing a thin, upstanding steel divider, and installing said divider at said juncture to separate, within the vicinity of said juncture, the inner seals that are that installed in said troughs.

21. The method of claim 1 wherein the steps of providing and installing outer segment means include the steps of providing and installing the outer segments of each of said sub-sets to define the associated radially inwardly facing surface as having a truncated conical form that is inclined with respect to the associated radially outwardly facing surface so as to narrow the width of bottom portions of said inner seal positioning trough so that, as the associated inner seals is compressed within the associated trough by the seating of the associated inner enclosure of the furnace atop said inner seal means, the associated inner seal will continue to extend substantially the full radially measured distance between the associated pair of radially outwardly facing and radially outwardly facing surfaces at such locations within the associated trough as are occupied by the associated inner seal.

22. The method of claim 1 wherein the steps of providing and installing outer segment means include the steps of providing and installing outer segments that cooperate to define portions of an outer seal trough wherein an outer seal of the furnace can be carried that engages the outer enclosure of the furnace when the outer enclosure is seated atop the outer segment means.

23. The method of claim 1 wherein the steps of providing and installing inner seal means include the steps of connecting a set of selected ones of the fiber blocks of one of the inner seals, and such thin metal members as are interspersed thereamong, to form an elongate module, and installing the module as a unit in the associated inner seal positioning trough.

24. The method of claim 23 wherein the steps of providing and installing inner seal means include the steps of including within the set of selected fiber blocks two fiber blocks that are "end blocks" inasmuch as they are located at opposite ends of the elongate module, and at least one "central" fiber block that is located between the two end blocks, and the step of connecting includes the step of inserting at least one elongate connector member to extend substantially centrally through the elongate module so as to extend through not only the end and central blocks but also through the perforated metal members that are included in the module.

25. The method of claim 23 wherein the steps of providing and installing inner seal means include the steps of including within the set of selected fiber blocks at least four central fiber blocks arranged serially between the two end blocks, and the step of connecting includes the step of inserting said elongate connector member to extend substantially centrally through all of the end and central blocks.

26. The method of claim 25 wherein the steps of providing and installing a module include the steps of incorporating in the module two metal members that are "end members" inasmuch as they are located at extreme opposite ends of the elongate module, and at least two "central" metal members that each are interposed between a separate adjacent pair of the set of selected fiber blocks, and the step of connecting includes connected opposite ends of the elongate connector member to said end members.

27. The method of claim 26 wherein the step of connecting includes the step of substantially uniformly compressing all of the fiber blocks of the set so that the length of said module as measured by the distance between the end members is less than it would be if the module were formed utilizing non-compressed fiber blocks.

28. The method of claim 27 wherein the step of substantially uniformly compressing the set of fiber blocks is carried out in such a way as to cause each of the blocks of the set to have a length, when compressed, that is about two-thirds of its non-compressed length.

29. The method of claim 23 wherein the step of forming the elongate module includes the step of forming the module such that it is substantially straight, and the step of installing the module in an associated trough includes the step of bending the module to an arcuate shape that corresponds to the curvature of the associated trough.

30. The method of claim 23 wherein the steps of providing and installing the inner seal means include the steps of providing and installing a plurality of said elongate modules, with each module including a separate set of fiber blocks together with such metal members as are interspersed thereamong.

31. The method of claim 30 wherein the steps of providing and installing the inner seal means include the steps of providing and installing a plurality of individual spacer fiber blocks, with a sufficient number of the spacer blocks being provided so that at least one compressed spacer block can be installed between each adjacent pair of the installed modules.

32. The method of claim 1 wherein the step of providing the inner seal means includes the step of providing ceramic refractory fiber blocks that have opposite end surfaces that are to be positioned in the associated trough so as to extend generally radially with respect to the associated trough, that have elongate fibers of ceramic refractory material, with the fibers of each block being sufficiently aligned so as to define a readily perceptible direction of orientation that extends substantially parallel to the opposed end surfaces of the block, and the step of installing the inner seal means includes the step of installing each of the fiber blocks in the associated inner seal positioning trough with the the end surfaces of each block extending substantially radially with respect to the length of the associated trough, whereby the the fibers of the blocks are oriented to extend generally in planes that extend substantially radially, not substantially circumferentially, with respect to the associated inner seal positioning trough.

33. The method of claim 1 wherein the step of providing inner seal means includes the step of providing said fiber blocks such that they have a substantially uniform width that is at least substantially equal to the maximum width of such portions of the associated trough as are to be occupied by said blocks; the steps of providing and installing said inner segment means and said outer segment means are carried out so that the associated trough, which is defined by a space located between said inner segment means and said outer segment means, is of tapered cross section with a progressively diminishing width being encountered at progressively deeper trough depths; and the step of installing the inner seal means is carried out by causing said blocks to be compressed in radially extending directions as said blocks are installed in the associated trough so that said blocks substantially fill the width of such portions of the associated trough as are occupied by said blocks.

34. The method of claim 33 wherein the step of providing the inner seal means includes the step of providing said perforated metal members in a form having a height that is less than the height of said fiber blocks, and the step of installing the inner seal means includes the step of inserting both the metal members and the fiber blocks to extend into bottom regions of the associated trough, with the metal members being sufficiently stiff to reinforce lower portions of the inner seal that is formed by said blocks and said members to prevent the inner seal from being crushed within the associated trough to a height that is less than the height of said metal members.

35. The method of claim 1 wherein the step of providing said inner segment means includes the step of mold-forming castable ceramic refractory material to mold a cast refractory inner segment while forcefully vibrating the mold to cause the castable ceramic material to "flow" properly to substantially fill all significant voids within the mold, and curing the molded cast refractory inner segment in a temperature controlled environment.

36. The method of claim 35 wherein the step of mold-forming castable ceramic refractory material includes the step of providing at least one anchor-carrying lift-engageable formation in said mold for being molded into the cast refractory inner segment, with the lift-engageable formation being accessible along an outer, upwardly-facing surface of the resulting cast refractory inner segment for connection to a crane to permit the cast refractory inner segment to be lifted by a crane during installation of the cast refractory inner segment.

37. The method of claim 1 wherein the step of providing said outer segment means includes the step of mold-forming castable ceramic refractory material to mold a cast refractory outer segment while forcefully vibrating the mold to cause the castable ceramic material to flow properly to substantially fill all significant voids within the mold, and curing the molded cast refractory outer segment in a temperature controlled environment.

38. The method of claim 37 wherein the step of mold-forming castable ceramic refractory material includes the step of providing at least one anchor-carrying lift-engageable formation in said mold for being molded into the cast refractory outer segment, with the lift-engageable formation being accessible along an outer, upwardly-facing surface of the resulting cast refractory outer segment for connection to a crane to permit the cast refractory outer segment to be lifted by a crane during installation of the cast refractory outer segment.

39. The method of claim 1 wherein the step of providing inner segment means includes the step of providing at least one cast refractory inner segment that has lift connection means anchored into the cast refractory material from which the segment is formed for defining three spaced lift attachment points to which connection can be made with a crane to permit the segment to be lifted and moved about, with each of the three spaced lift attachment points opening through a single outer surface of the segment that faces upwardly when said one inner segment is installed as a component of said refractory base, and the step of installing the cast refractory inner segment means includes the step of connecting each of the three lift attachment points of said one inner segment to a crane, and operating the crane to lift and move said one inner segment into an installed position.

40. The method of claim 1 wherein the step of providing outer segment means includes the step of providing at least one cast refractory outer segment that has lift connection means anchored into the cast refractory material from which the segment is formed for defining three spaced lift attachment points to which connection can be made with a crane to permit the segment to be lifted and moved about, with each of the three spaced lift attachment points opening through a single outer surface of the segment that faces upwardly when said one outer segment is installed as a component of said refractory base, and the step of installing the cast refractory outer segment means includes the step of connecting each of the three lift attachment points of said one outer segment to a crane, and operating the crane to lift and move said one outer segment into an installed position.

41. A method of forming a plurality of substantially endless, continuous, circumferentially extending, upwardly-facing seals of somewhat resilient character in a plurality of generally annular-shaped, circumferentially extending, upwardly opening, seal positioning troughs of a plural-stack annealing furnace base, wherein each seal is formed in a separate associated one of the troughs, comprising the steps of:

a) providing a plurality of sets of ceramic fiber block means, with each set including a plurality of ceramic fiber blocks for each being arranged serially in a separate associated circumferentially extending, endless, ring-like array within the confines of a separate associated one of said seal positioning troughs, with the blocks of each set having a radially extending width that is sufficient to extend substantially the full radially-measured width of the associated trough at locations within the associated trough where said blocks are to be installed, and with the blocks of each set being sufficient in number and in size to require that the blocks of each set be compressed in directions extending circumferentially with respect to the associated trough in order for all of the blocks of each set to be inserted serially into the associated troughs to form said arrays;

b) providing a plurality of sets of relatively thin, perforated metal members, and interspersing the members of each set among the ceramic fiber blocks of a separate associated one of the sets of blocks, so that the metal members of each set will extend substantially radially at circumferentially spaced intervals within the confines of the associated trough once the fiber blocks have been installed in the troughs; and, c) installing the interspersed sets of fiber blocks and metal members into said associated troughs to form said serial arrays with the metal members of each set interspersed among the fiber blocks of an associated set, and with the fiber blocks of each set being compressed in directions extending circumferentially with respect to the associated trough in order for all of said blocks of all of the sets to be included in the serial arrays.

42. The method of claim 41 additionally including the steps of providing blanket means including a separate relatively thin lower blanket of ceramic fiber refractory material for each being installed in a separate associated one of said troughs, and installing each of the blankets in a separate associated one of the troughs to underlie the associated array of fiber blocks and metal members that is installed in the associated trough.

43. The method of claim 41 additionally including the steps of providing blanket means including a separate relatively thin upper blanket of ceramic fiber refractory material for each being installed in a separate associated one of said troughs, and installing each of the blankets in a separate associated one of the troughs to overlie the associated array of fiber blocks and metal members that is installed in the associated trough.

44. The method of claim 41 additionally including the step of forming a plurality of sets of elongate modules, with each set of modules being intended for insertion into a separate associated one of the troughs, wherein each module includes a separately compressed set of adjacent ones of said blocks together with such metal members as are interspersed thereamong, and wherein the step of installing the fiber blocks and the metal members in the troughs includes the step of installing the sets of blocks and their interspersed metal members as modular units.

45. The method of claim 44 wherein the step of installing the fiber blocks and the metal members in said troughs includes the additional step of installing individual ones of said fiber blocks as spacers between adjacent pairs of the modules, with the fibers of the installed spacer blocks being compressed to substantially the same extent as are the fibers of the blocks that are included in the elongate modules.

46. The method of claim 41 wherein the step of connecting the blocks and metal members of each of the modules includes the steps of providing and installing in each of the modules a separate pair of elongate connecting members that extend in spaced, side by side relationship substantially centrally through each of the elongate modules, with opposite ends of each module being capped by a pair of said metal members that are connected to opposite ends of the connecting members for holding in compression the blocks and metal members of the module.

47. The method of claim 41 wherein the step of providing the modules includes the step of forming the modules such that they are of generally straight form, and the step of installing the modules includes the step of bending each of the modules sufficiently to facilitate installation of the module within a curved portion of the associated seal positioning trough.

48. A method of forming substantially endless, continuous, circumferentially extending, upwardly-facing seals in each of a plurality of generally annular-shaped, circumferentially extending, upwardly opening, seal positioning troughs of a plural-stack annealing furnace base, wherein each seal installed in each of the associated troughs has relatively stiff lower portions and relatively resilient upper portions, comprising the steps of:

a) providing ceramic fiber block means including a plurality of sets of generally cubically shaped ceramic fiber blocks, with each set being intended to be arranged serially in a separate associated endless, ring-like array within the confines of the associated seal positioning trough, with each of said blocks having a pair of opposed side walls, a pair of opposed top and bottom walls, and a pair of opposed end walls, with the distance between the opposed side walls being sufficient to define a seal width sufficient to extend substantially the full radially-measured width of the associated trough at locations within the associated trough where said blocks are to be installed, with the elongate refractory fibers that comprise each of the blocks being sufficiently aligned so as to define a readily perceptible direction of orientation that extends substantially parallel to the opposed end surfaces of the block, and with said blocks of each set being sufficient in number and in size to require that said blocks of each set be compressed in directions extending circumferentially with respect to the associated trough in order for all of said blocks to be inserted serially into the associated trough to form the associated array;

b) providing a plurality of sets of relatively thin, perforated metal members that are of relatively square shape, with said shape being defined by a pair of opposed side edges and by a pair of opposed top and bottom edges, with the distance between the opposed top and bottom edges being less than the distance between the opposed top and bottom surfaces of said blocks; and, c) installing said sets of fiber blocks and said sets of metal members in the associated troughs in serial arrays with the metal members of each set interspersed among the fiber blocks of each associated set, and extending in planes that are substantially radially oriented with respect to the associated trough, with the fibers of said blocks also being oriented to extend in substantially radially oriented planes with respect to the associated trough, and with the bottom edges of said metal members being substantially aligned with the bottom surfaces of the associated fiber blocks, whereby said metal members serve to reinforce bottom portions of the resulting seals but do not extend upwardly into upper portions of the resulting seals.

49. The method of claim 48 additionally including the steps of providing blanket means for being positioned in said troughs together with said arrays, including a separate, relatively thin lower blanket of ceramic fiber refractory material for insertion into each of the troughs, and installing said lower blankets in said troughs to underlie said arrays.

50. The method of claim 48 additionally including the steps of providing blanket means for being positioned in said troughs together with said arrays, including a separate, relatively thin upper blanket of ceramic fiber refractory material for insertion into each of the troughs, and installing said upper blankets in said troughs to overlie said arrays.

51. The method of claim 48 additionally including the step of packing the resulting seals firmly in said troughs by positioning a ring-shaped steel structure sequentially atop each of the installed seals in engagement with the upwardly facing surfaces of the installed seals, and, during such engagement with each of the upwardly facing surfaces, applying downward pressure to said ring-shaped steel structure to concurrently, substantially uniformly compress the associated array downwardly into the associated trough, and to also thereby flatten the associated upwardly facing surface of the associated seal.

52. A method of refurbishing each of a plurality of generally annular shaped, upwardly facing, trough-contained refractory fiber inner seals of a plural stack annealing furnace wherein each of said seals is formed from a circumferentially extending serial array of blocks of fiber refractory material interspersed with thin pieces of perforated metal that reinforce bottom portions of the array, comprising the steps of positioning a ring-shaped steel structure sequentially atop each of the fiber seals in engagement with its upwardly facing surface, and applying downward pressure to said ring-shaped steel structure while it is positioned atop each of the seals to concurrently, substantially uniformly compress the fiber refractory material of each seal downwardly into the associated trough that contains each seal, and to also thereby flatten the upwardly facing surfaces of the seals.

53. The method of claim 52 wherein the upwardly facing surface of each of said seals is defined by a separate elongate blanket of fiber refractory material positioned atop the associated array, and the refurbishing process includes the step of replacing each of said blankets to ensure that the refurbished seals will have upwardly facing surfaces of good integrity.

54. A method of building a plural stack annealing furnace base in an off-site facility that is removed from a furnace site where the base is to be installed, wherein the facility has a crane of sufficient lift capacity to pick up at least one of each of the heavier base components which include a base support structure, a plurality of cast refractory inner segments, a plurality of cast refractory outer segments, comprising the steps of:

a) forming as a welded steel assembly, at a location within the off-site facility, a generally rectangular base support structure of a plural-stack annealing furnace;

b) utilizing a crane of the off-site facility to lift the base support structure onto a flat bed of a flat bed vehicle that is parked at the off-site facility;

c) installing atop the bed-supported base support structure a plurality of cast refractory inner segments by utilizing the crane to lift each of the cast refractory inner segments onto the bed-supported base structure, and to arrange the inner segments atop the bed-supported base structure in spaced apart sets with each set of inner segments being configured 1) to define a separate associated annular-shaped inner portion of a rigid ceramic refractory base of a plural-stack annealing furnace, 2) to underlie and support a separate associated one of a plurality of generally circular charge support structures of the furnace, and 3) to define a separate associated one of a plurality of substantially continuous, radially outwardly facing surfaces that each extends substantially concentrically about a separate associated one of the circular charge support structures at a location near the periphery thereof;

d) installing atop the bed-supported base support structure a plurality of cast refractory outer segments by utilizing the crane to lift each of the cast refractory outer segments onto the bed-supported base structure, and to arrange the outer segments atop the bed-supported base structure in spaced apart sub-sets with each sub-set of outer segments being configured to extend about an associated separate one of said annular-shaped inner portions to define arcuate portions of a separate associated, radially inwardly facing surface that extends concentrically about a separate associated one of said radially outwardly facing surfaces so as to cooperate therewith to define opposite, radial spaced sides of an associated inner seal positioning trough for extending circumferentially about a separate associated one of the circular charge support structures of the furnace;

e) installing inner seal means into said troughs atop the base support structure for defining a plurality of inner seals 1) that each extend in a separate one of said troughs in a substantially uninterrupted manner about the periphery of a separate associated one of the circular charge support structures, 2) that each has metal reinforcement interspersed thereamong so as to be is capable of supporting the weight of a separate associated open-bottom inner enclosure of the furnace when bottom rim portions of the associated inner enclosure are seated thereatop, and 3) that each is sufficiently resilient to cooperate with the seated bottom rim portions of the associated inner enclosure to form a gas impervious seal for isolating the environment of an associated treatment chamber;

f) moving the truck from the off-site facility to a furnace location where the assembled base is to be installed; and, g) utilizing a crane at the furnace location to lift the assembled base from the truck, and to put the assembled base into an operating position at said furnace location.

55. The method of claim 54 additionally including the steps of:

a) providing upstanding lifting arms affixed to opposite sides of the base support structure at spaced intervals therealong for being connected to a crane to permit the base to be lifted and moved from place to place;

b) providing lifting fixture means configured to be connected to all of said lifting arms, and providing a single connection that can be coupled to a crane so that, when a crane lifts the lifting fixture means, the lifting fixture means will apply force to said base through said lifting arms to lift said base;

c) connecting the lifting fixture to all of said lifting arms, and connecting the single connection of the lifting fixture to a crane at said furnace location; and, d) operating the crane at the furnace location to lift the lifting fixture which, in turn, lifts the assembled base, to lift the assembled base from the truck, and to put the assembled base into an operating position at said furnace location.

56. The method of claim 55 additionally including the step of cutting off portions of said lifting arms at a time after the assembled base has been put into its operating position at said furnace location, to prevent portions of said lifting arms from interfering with operation of the annealing furnace.

57. A method of carrying out an annealing process in a closed, controlled environment of a plural-stack annealing furnace, comprising the steps of:

a) providing a plural stack annealing furnace, including the steps of providing a base, providing a plurality of removable, open-bottom inner covers configured to cooperate with the base and to extend upwardly therefrom to define a plurality of side by side treatment chambers within which charges of metal can be simultaneously received and contained for being subjected to an annealing process, providing furnace structure configured to extend about the inner covers to provide heat energy for heating the contents of the treatment chambers during an annealing process, and providing seal means 1) connected to the base, 2) extending perimetrically and continuously about bottom regions of the treatment chambers, and 3) being configured to be compressively engaged by substantially continuous bottom rim portion of the open-bottom inner covers when the inner covers are positioned to cooperate with the base to define said treatment chambers i) for supporting at least a portion of the weight of the inner covers atop the base, and ii) for establishing seals between the base and the inner covers that will permit closed, controlled environments of desired character to be maintained within the treatment chambers during annealing of charges of metal contained therein;

b) supporting separate charges of metal on the base at locations within each of the treatment chambers for being annealed;

c) positioning the inner covers to extend about the base-supported charges of metal, with the bottom rim portions of the inner covers compressively engaging the seal means so as to establish seals between the base and the inner covers that isolate the environments of the treatment chambers, with the base and the inner covers cooperating to house the base-supported charges of metal within the isolated environments of the treatment chambers;

d) heating the base-supported, chamber-housed charges of metal within the isolated environment of the treatment chambers to initiate an annealing process of desired character while maintaining a gas atmosphere of desired character within the treatment chambers, and completing the conduct of the annealing process by continuing to control the treatment chamber environments;

e) withdrawing the inner covers from compressive engagements with the inner seals and from positions wherein the covers surrounded the charges of annealed metal so that the charges of annealed metal can be removed from atop the base;

f) wherein the step of providing a base includes the steps of:

1) providing inner base structure that defines a plurality of spaced, upwardly facing support surface locations for receiving and supporting the charges of metal that are to be annealed, and that defines about each of said locations an associated outer surface which extends perimetrically about its associated charge support location;

2) providing outer base structure that extends about the inner base structure, and that defines a separate substantially continuous inner surface to extends perimetrically about and to face generally toward each of the outer surfaces of the inner base structure at substantially uniform distances therefrom so as to define seal mounting troughs of substantially uniform width that extend continuously about the charge support locations, into which troughs the substantially continuous bottom rim portions of the open-bottom inner covers will extend when the inner cover is positioned to cooperate with the base to define said treatment chamber;

g) wherein the step of providing seal means includes the steps of:

1) providing a plurality of sets of generally cube-shaped bodies of fibrous refractory material that each define an associated pair of opposed, substantially parallel extending top and bottom surfaces as well as an associated pair of opposed, substantially parallel extending side surfaces and an associated pair of opposed, substantially parallel extending end surfaces, with each of the cube-shaped bodies having its refractory fibers oriented to extend in directions that generally parallel the associated pair of end surfaces thereof, and with the distance between the opposed side surfaces of each of the cube-shaped bodies being selected to substantially equal said uniform width of an associated one of the seal mounting troughs;

2) arranging the sets of cube-shaped bodies of refractory material in serial, end-to-end relationships to form elongate arrays, with adjacent bodies of each of the arrays having their end surfaces facing toward each other and extending in substantially parallel planes, with the bodies being oriented such that the opposed pairs of top and bottom surfaces extend substantially contiguously to define opposed top and bottom surfaces of the array, and, with the bodies being oriented such that the opposed pairs of side surfaces extend substantially contiguously to define opposed side surfaces of the array;

3) inserting a plurality of thin, generally rectangular-shaped, perforated metal members into each of the elongate arrays to interleave the metal members among the cube-shaped bodies of refractory material at locations between end surfaces of adjacent ones of the cube-shaped bodies of refractory material, with the metal members each having a bottom edge that is positioned so that it substantially aligns with the bottom surface of the associated array;

4) installing the interleaved arrays in the seal mounting troughs by longitudinally compressing the cube-shaped bodies and the metal members in such a way that opposed side surfaces of the arrays are caused to extend along closely alongside the outer surfaces of the inner base structure and along the inner surfaces of the outer base structure, and with the longitudinal compression of the interleaved arrays i) causing the opposed end surfaces of each of the cube-shaped bodies to be brought closer together, ii) causing the perforated metal members of each array to be clamped tightly into engagement with the end surfaces of adjacent ones of the cube-shaped bodies, iii) causing at least some fibers of the compressed bodies to extend into perforations of the metal members, iv) causing the metal members to reinforce, rigidify and strengthen the compressed, interleaved arrays, and v) thereby enabling the installed, compressed, interleaved arrays to support at least a portion of the weight of the inner cover structures when bottom rims of the inner cover structures are positioned to compressively engage the seal means.

* * * * *